US009833967B2

(12) United States Patent
Kushida et al.

(10) Patent No.: US 9,833,967 B2
(45) Date of Patent: Dec. 5, 2017

(54) SHEET PROCESSING APPARATUS AND IMAGE FORMING APPARATUS

(71) Applicant: CANON KABUSHIKI KAISHA, Tokyo (JP)

(72) Inventors: Hideki Kushida, Moriya (JP); Kiyoshi Watanabe, Matsudo (JP); Naoto Tokuma, Kashiwa (JP); Toshiyuki Iwata, Abiko (JP); Akito Sekigawa, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 195 days.

(21) Appl. No.: 14/693,167

(22) Filed: Apr. 22, 2015

(65) Prior Publication Data

US 2015/0314626 A1 Nov. 5, 2015

(30) Foreign Application Priority Data

Apr. 30, 2014 (JP) ..... 2014-093864

(51) Int. Cl.

| | |
|---|---|
| ***B31F 5/02*** | (2006.01) |
| ***B42F 3/00*** | (2006.01) |
| ***B65H 31/34*** | (2006.01) |
| ***B31F 1/00*** | (2006.01) |
| ***B65H 37/04*** | (2006.01) |
| ***B42B 5/00*** | (2006.01) |

(52) U.S. Cl.

CPC ..... *B31F 5/02* (2013.01); *B31F 1/00* (2013.01); *B42B 5/00* (2013.01); *B42F 3/00* (2013.01); *B65H 31/34* (2013.01); *B65H 37/04* (2013.01); *B65H 2301/51616* (2013.01); *B65H 2801/27* (2013.01)

(58) Field of Classification Search

CPC ..... B42B 5/00; B31F 1/00; B31F 5/02; B42F 3/00; G03G 2215/00852; B65H 37/04; B65H 31/34; B65H 2301/51616; B65H 2801/27

USPC ..... 270/58.07, 58.08, 58.12, 58.17, 58.27

See application file for complete search history.

(56) References Cited

U.S. PATENT DOCUMENTS

| | | | | |
|---|---|---|---|---|
| 3,577,575 | A * | 5/1971 | Taniguchi | B31F 5/027 29/564 |
| 7,866,645 | B2 | 1/2011 | Fujita et al. | |
| 8,139,998 | B2 * | 3/2012 | Hayasaka | B42C 1/125 399/407 |

(Continued)

FOREIGN PATENT DOCUMENTS

| | | | |
|---|---|---|---|
| JP | 2012-025499 | A | 2/2012 |
| JP | 5056918 | B2 | 10/2012 |

*Primary Examiner* — Leslie A Nicholson, III

(74) *Attorney, Agent, or Firm* — Fitzpatrick, Cella, Harper & Scinto

(57) ABSTRACT

A sheet processing apparatus includes a first stacking portion on which a sheet conveyed by a conveying portion is stacked, a binding portion which forms, in a sheet bundle stacked on the first stacking portion, a tongue cut out from the sheet, with a part of the tongue attached to the sheet, and a slit, and which binds the sheet bundle by inserting a tip of the tongue of the sheet bundle in the slit of the sheet bundle, and a second stacking portion on which the sheet bundle bound by the binding portion is stacked. In the sheet processing apparatus, a plurality of recessed parts is formed on a guide face of the binding portion, the recessed parts extending in different directions from each other.

14 Claims, 20 Drawing Sheets

(56) References Cited

U.S. PATENT DOCUMENTS

| | | | | |
|---|---|---|---|---|
| 8,226,078 | B2 | 7/2012 | Watanabe et al. | |
| 8,231,120 | B2 | 7/2012 | Hayashi et al. | |
| 8,246,033 | B2 * | 8/2012 | Sato | B42C 1/12 270/58.07 |
| 8,302,951 | B2 | 11/2012 | Watanabe et al. | |
| 8,408,531 | B2 * | 4/2013 | Sato | B65H 37/04 270/58.07 |
| 8,540,228 | B2 | 9/2013 | Shiraishi | |
| 8,622,378 | B2 | 1/2014 | Sekigawa | |
| 8,774,702 | B2 | 7/2014 | Sekigawa | |
| 9,010,744 | B2 | 4/2015 | Tokuma et al. | |
| 9,096,407 | B2 * | 8/2015 | Gamo | B31F 1/07 |
| 9,139,397 | B2 * | 9/2015 | Sato | B42B 9/00 |
| 2008/0101836 | A1 | 5/2008 | Fujita et al. | |
| 2012/0018944 | A1 | 1/2012 | Shiraishi | |
| 2014/0015187 | A1 * | 1/2014 | Gamo | B65H 37/04 270/1.01 |
| 2015/0123338 | A1 | 5/2015 | Iwata et al. | |

* cited by examiner

SHEET PROCESSING APPARATUS AND IMAGE FORMING APPARATUS

BACKGROUND OF THE INVENTION

Field of the Invention

The present invention relates to a sheet processing apparatus which binds a sheet bundle, and an image forming apparatus including the same.

Description of the Related Art

There has been disclosed a sheet processing apparatus which binds a sheet on which an image has been formed and stacks the sheet as a sheet bundle on a predetermined tray. For example, in the U.S. Patent Application Publication No. 2012/018944 A1, a technique for binding a plurality of sheets without using a staple is described. Specifically, a half-blanked tongue and a slit are formed on a sheet by cutting, and a tip of the half-blanked tongue is inserted in the slit, whereby the stacked sheets are bound together. However, such sheet processing apparatuses are not always highly operable.

In view of the above problem, it is desirable to provide a sheet processing apparatus with improved operability.

SUMMARY OF THE INVENTION

To achieve improved performance of a sheet processing apparatus, the sheet processing apparatus according to an exemplary embodiment of the present invention includes a first stacking portion on which a sheet conveyed by a conveying portion is stacked, a binding portion which forms, in a sheet bundle stacked on the first stacking portion, a tongue cut out from the sheet, with apart of the tongue attached to the sheet, and a slit, and which binds the sheet bundle by inserting a tip of the tongue of the sheet bundle in the slit of the sheet bundle, and a second stacking portion on which the sheet bundle bound by the binding portion is stacked. In the sheet processing apparatus, a plurality of recessed parts is formed on a guide face of the binding portion. The recessed parts extend in different directions from each other.

Further features of the present invention will become apparent from the following description of exemplary embodiments with reference to the attached drawings.

DESCRIPTION OF THE EMBODIMENTS

Figure 1:
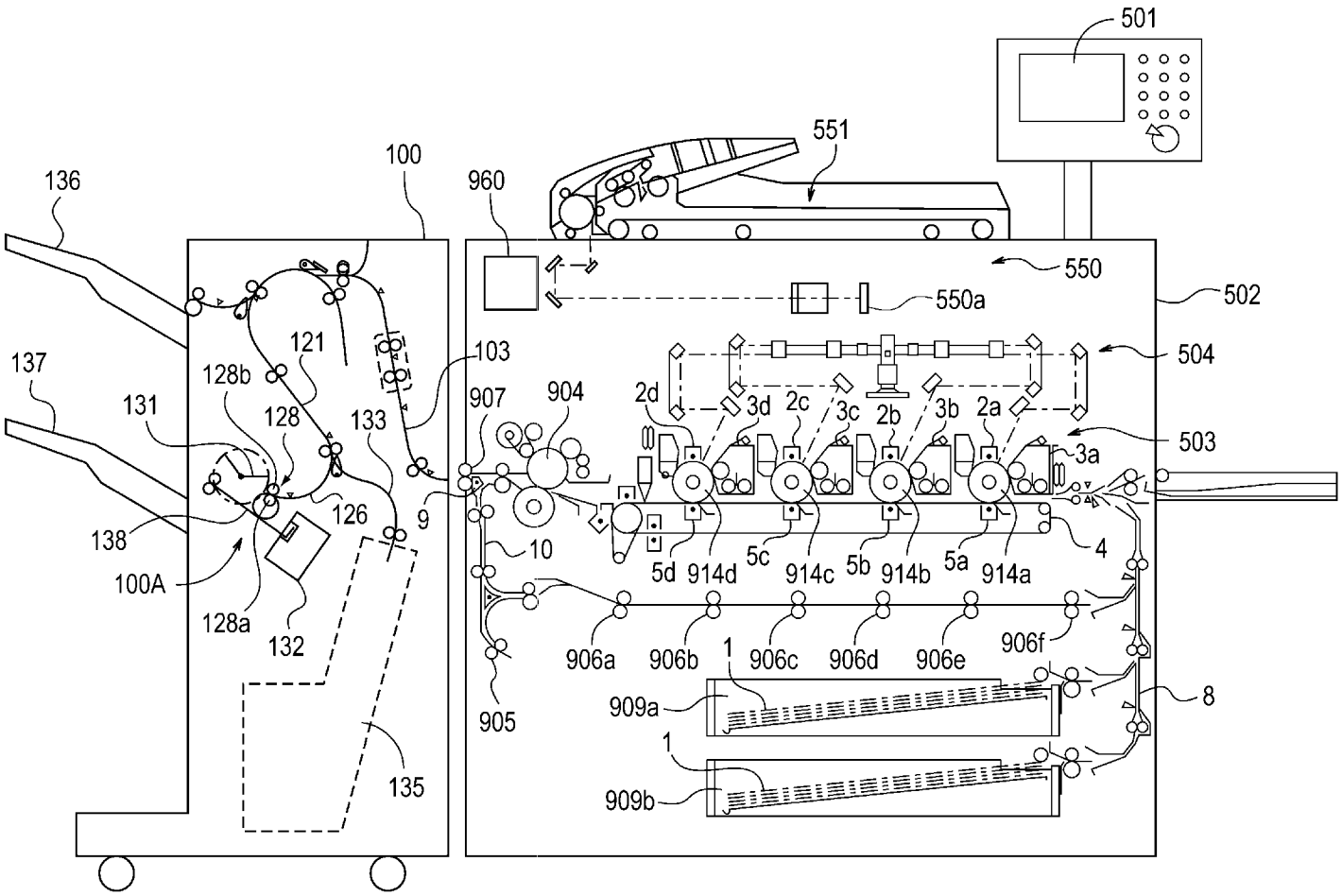
FIG. 1 is an explanatory sectional view showing a configuration of an image forming apparatus including a sheet processing apparatus, according to an exemplary embodiment of the present invention.

Hereinbelow an embodiment of the image forming apparatus including the sheet processing apparatus according to the present invention will be described in detail, with reference to the attached drawings. FIG. 1 is an explanatory sectional view showing a configuration of the image forming apparatus including the sheet processing apparatus according to the embodiment of the invention. FIG. 1 shows the image forming apparatus 502, an original-reading portion (an image reader) 550 placed in an upper part of the body of the image forming apparatus 502, and an original-conveying device 551 which is used to read a plurality of originals automatically.

<Image Forming Apparatus>

The image forming apparatus 502 has a sheet cassette 909*a*, 909*b*, on which a sheet 1 is placed. The sheet 1 is a recording material on which a toner image is formed. The image forming apparatus 502 also has an image forming portion 503. The image forming portion 503 forms a toner image on the sheet 1 by means of an electrophotographic-image-forming processing portion. Further, the image forming apparatus 502 has a fixing device 904 serving as a fixing portion which fixes a toner image formed on the sheet 1.

An operation portion 501 is situated on an upper surface of the body of the image forming apparatus 502. A user inputs various data into the image forming apparatus 502 or adjusts the settings thereon through the operation portion 501. A finisher 100 which serves as a sheet processing apparatus is connected to the side of the body of the image forming apparatus 502. A controller 960 controls the image forming apparatus 502 and the finisher 100 serving as the sheet processing apparatus.

In the image forming apparatus 502 of the embodiment, an image on the original (not shown) is formed on the sheet 1 in the following manner. First, an image sensor 550*a* serving as an image reading portion reads the image on the original conveyed by an original-conveying device 551. The image sensor 550*a* is situated in an original-reading portion 550. Then, digital data read by the image sensor 550*a* are input into an exposing device 504 serving as an exposing portion. The exposing device 504 irradiates surfaces of photosensitive drums 914*a*-914*d* with light according to the digital data. The photosensitive drums 914*a*-914*d* are situated in the image forming portion 503. Each of the photosensitive drums 914*a*-914*d* serves as an image bearing member. For the convenience of explanation, the photosensitive drums 914*a*-914*d* may be referred to collectively as a photosensitive drum 914. Other image-forming processing portions may be referred to in the same manner.

A surface of the photosensitive drum 914 is uniformly electrified by an electrifying device 2 serving as an electrifying portion. When the uniformly electrified surface of the photosensitive drum 914 is irradiated with light by the exposing device 504, an electrostatic latent image is formed on the surface of the photosensitive drum 914. A developing device 3 serving as a developing portion supplies the electrostatic latent image with a toner which acts as a developer, to develop the latent image. As a result, a toner image in respective colors of yellow, magenta, cyan, and black is formed on the surface of the photosensitive drum 914.

Meanwhile, the sheet 1 fed from the sheet cassette 909*a*, 909*b* is conveyed by a conveying belt 4, via a conveying path 8, to a position so as to face each of the photosensitive drums 914*a*-914*d*. Then, by the action of a transferring device 5*a*-5*d* serving as a transferring portion, the toner image which has been formed on the surface of each of the photosensitive drums 914*a*-914*d* in the respective four colors is transferred sequentially to the sheet 1 conveyed by the conveying belt 4. The transferring device 5*a*-5*d* is arranged on an inner circumference side of the conveying belt 4.

Subsequently, the fixing device 904 serving as the fixing portion applies heat and pressure on the toner image having been transferred to the sheet 1, to fix the toner image permanently. After the toner image is fixed on the sheet 1, when the image forming apparatus 502 is in a mode of forming an image on a single side of the sheet 1, the sheet 1 is directly discharged to the finisher 100 by a discharge roller 907.

When the image forming apparatus 502 is in a mode of forming an image on two sides of the sheet 1, a flapper 9 switches directions so that the sheet 1 discharged from the fixing device 904 is led to a conveying path 10 to be passed to an reversing roller 905. Then, the reversing roller 905 reversely rotates with a predetermined timing so that the sheet 1 can be conveyed by a double-sided conveying roller 906*a*-906*f*.

Subsequently, the sheet 1 is conveyed again to the image forming portion 503, and a toner image in the respective four colors of yellow, magenta, cyan, and black is transferred on the reverse side of the sheet 1. The sheet 1, on the reverse side of which the toner image in the respective four colors is transferred, is again conveyed to the fixing device 904 to fix the toner image. After that, the sheet 1 is conveyed by the discharge roller 907 to the finisher 100 connected to the side of the body of the image forming apparatus 502.

Figure 2:
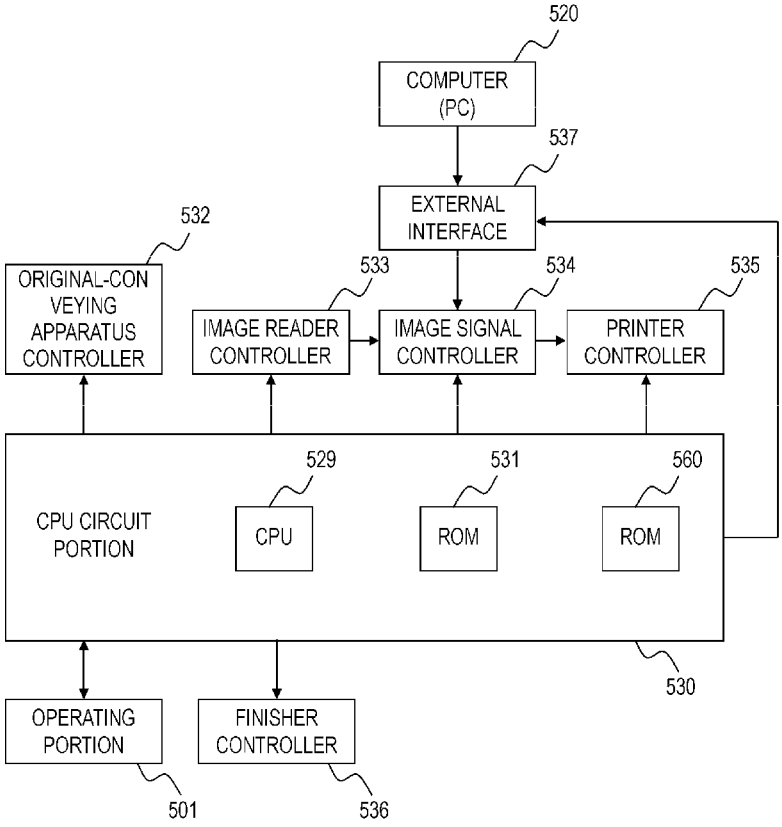
FIG. 2 is a block diagram showing a configuration of a control system of the image forming apparatus.

FIG. 2 is a block diagram showing a configuration of a control system of the image forming apparatus 502 having the finisher 100 serving as the sheet processing apparatus. FIG. 2 shows a Central Processing Unit (CPU) circuit portion 530 which serves as the controller. The controller is located in a predetermined position in the body of the image forming apparatus 502.

The CPU circuit portion 530 includes a CPU 529, and a Read Only Memory (ROM) 531 which stores a control program. The CPU circuit portion 530 also includes a region for temporarily retaining the control data, and a Random Access Memory (RAM) 560 which is used as a work area for control-related operation.

An external interface 537 is an external interface which connects the image forming apparatus 502 and an external computer (PC) 520. The external interface 537 receives print data from the external PC 520, develops the print data into a bitmap image, and outputs the image as image data to an image signal controller 534.

The image signal controller 534 outputs the image data to a printer controller 535. The printer controller 535 outputs the image data received from the image signal controller 534 to an exposure controller (not shown). An image reader controller 533 outputs an image on an original having been read by the image sensor 550*a* shown in FIG. 1 to the image signal controller 534. The image signal controller 534 outputs the image-output to the printer controller 535.

The operation portion 501 has a plurality of keys through which various functions related to image forming are set, and a display to show a setting. The operation portion 501 outputs a key signal corresponding to each keystroke by a user to the CPU circuit portion 530, and shows corresponding information on the display, based on the signal from the CPU circuit portion 530.

The CPU circuit portion 530 controls the image signal controller 534 according to a control program stored in the ROM 531 and a setting input through the operation portion 501. The CPU circuit portion 530 also controls the original-conveying device 551 shown in FIG. 1 through an original-conveying device controller 532. Further, the CPU circuit portion 530 controls the original-reading portion 550 shown in FIG. 1 through an image reader controller 533. The CPU circuit portion 530 controls the image forming portion 503 shown in FIG. 1 through the printer controller 535. The CPU circuit portion 530 controls the finisher 100 shown in FIG. 1 through a finisher controller 536.

In the embodiment, the finisher controller 536 is placed in the finisher 100. The finisher controller 536 controls driving of the finisher 100 by communicating with the CPU 529 and others in the CPU circuit portion 530. The finisher controller 536 may be placed in the body of the image forming apparatus 502 integrally with the CPU circuit portion 530, so that the finisher 100 can be controlled directly from the body of the image forming apparatus 502.

<Sheet Processing Apparatus>

Figure 3:
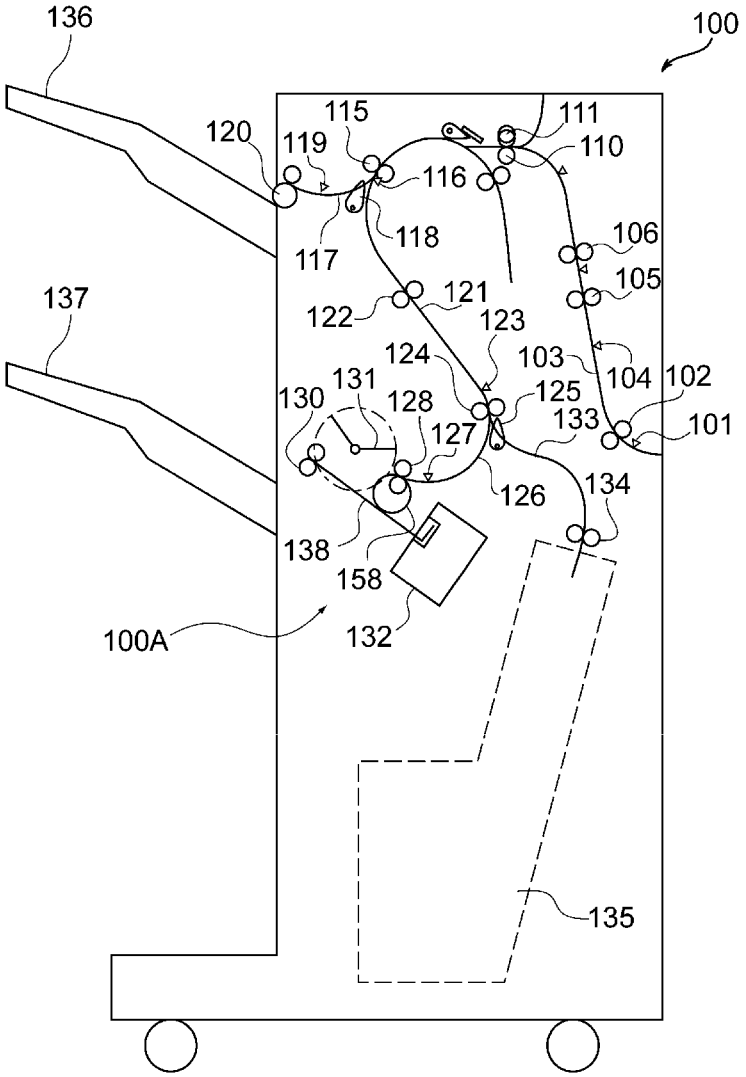
FIG. 3 is an explanatory sectional view showing a configuration of a finisher which serves as a sheet processing apparatus.

FIG. 3 is an explanatory sectional view of the finisher 100 which serves as a sheet processing apparatus. The finisher 100 according to the embodiment is connected, via the conveying paths, to the image forming portion 503 placed in the image forming apparatus 502. The finisher 100 performs a sheet process to the sheet 1 on which an image has been formed by the image forming portion 503.

In sheet processing, the finisher 100 receives the sheet 1 discharged from the body of the image forming apparatus 502 and conveys the sheet 1 in succession to the intermediate processing tray 138. Subsequently, the finisher 100 aligns and batches a plurality of the sheets 1 received so as to form a single sheet bundle 1*n*. The finisher 100 is able to punch the received sheet 1 so as to pierce a hole near the rear end part 1*a* of the received sheet 1. Moreover, the finisher 100 is able to perform other various processes such as a binding process with a stapler 132 which staples the rear end of the sheet bundle 1*n*, and a bookbinding process.

The finisher 100 has the intermediate processing tray 138 serving as the first stacking portion which holds the sheet 1 conveyed by a conveying path 103, 121, 126 serving as the sheet conveying portion. The finisher 100 also has a stapling portion 100A which staples the sheet bundle 1*n* on the intermediate processing tray 138, and a saddle unit 135 which half-folds and binds the sheet bundle 1*n*.

The finisher 100 includes an inlet roller 102 which takes in the sheet 1 discharged by the discharge roller 907 situated in the body of the image forming apparatus 502 to the inside of the finisher 100. The sheet 1 discharged from the body of the image forming apparatus 502 is received by the inlet roller 102. At the same time, an inlet sensor 101 detects a timing of receiving the sheet 1.

After that, the sheet 1 having been conveyed by the inlet roller 102 passes through a conveying roller 105, 106, moving along the conveying path 103. Subsequently, the sheet 1 is conveyed by a conveying roller 110 and a separating roller 111 to reach a buffer roller 115. Then, when the sheet 1 is discharged to an upper tray 136, an upper path switching member 118 is switched to a predetermined position by a driving portion such as a solenoid (not shown). As a result, an upper path conveying path 117 leads the sheet 1, so that the sheet 1 is discharged to the upper tray 136 by an upper discharge roller 120.

When the sheet 1 is not discharged to the upper tray 136, the sheet 1 having been conveyed by the buffer roller 115 is led to the conveying path 121 by the upper path switching member 118 in a state indicated by a solid line in FIG. 3. The sheet 1 is then conveyed by a conveying roller 122, 124, to pass along a series of conveying paths.

Next, a plurality of the sheets 1 which has been conveyed to the finisher 100 is bound by the stapler 132 serving as the binding portion, to make a sheet bundle 1*n*. Then, the sheet bundle 1*n* is discharged to a lower tray 137 serving as the second stacking portion on which the sheet bundles 1*n* is placed successively. In this case, the sheet bundle 1*n* is conveyed to a conveying path 126 by a saddle path switching member 125 in a state indicated by a solid line in FIG. 3.

The sheet 1 is discharged to the intermediate processing tray 138 by a pair of lower discharge rollers 128. The sheet 1 having been discharged to the intermediate processing tray 138 is placed successively in a stack while aligned by a returning portion including a paddle 131 and a belt roller 158. A predetermined number of sheets 1 are aligned on the intermediate processing tray 138, on which a sheet bundle 1*n* formed of the stacked and aligned sheets 1 is processed.

The sheet bundle 1*n* which has been aligning-processed on the intermediate processing tray 138 is bound with the stapler 132 as necessary. The sheet bundle 1*n* is then discharged to the lower tray 137 by a pair of sheet bundle discharge rollers 130.

When the sheet 1 is saddle-stitched, the saddle path switching member 125 is moved to a predetermined position by the driving portion such as a solenoid (not shown). As a result, the sheet 1 is conveyed to the saddle path 133, and led to the saddle unit 135 by a saddle inlet roller 134, to be saddle-stitched.

Timing of conveyance of the sheet 1 is controlled by a conveyance sensor 104, 123, 127 and so forth. The conveyance sensor 104, 123, 127 controls the timing by detecting the edge of the sheet 1 while the sheet 1 is conveyed along the conveying path 103, 121, 126.

Figure 4:
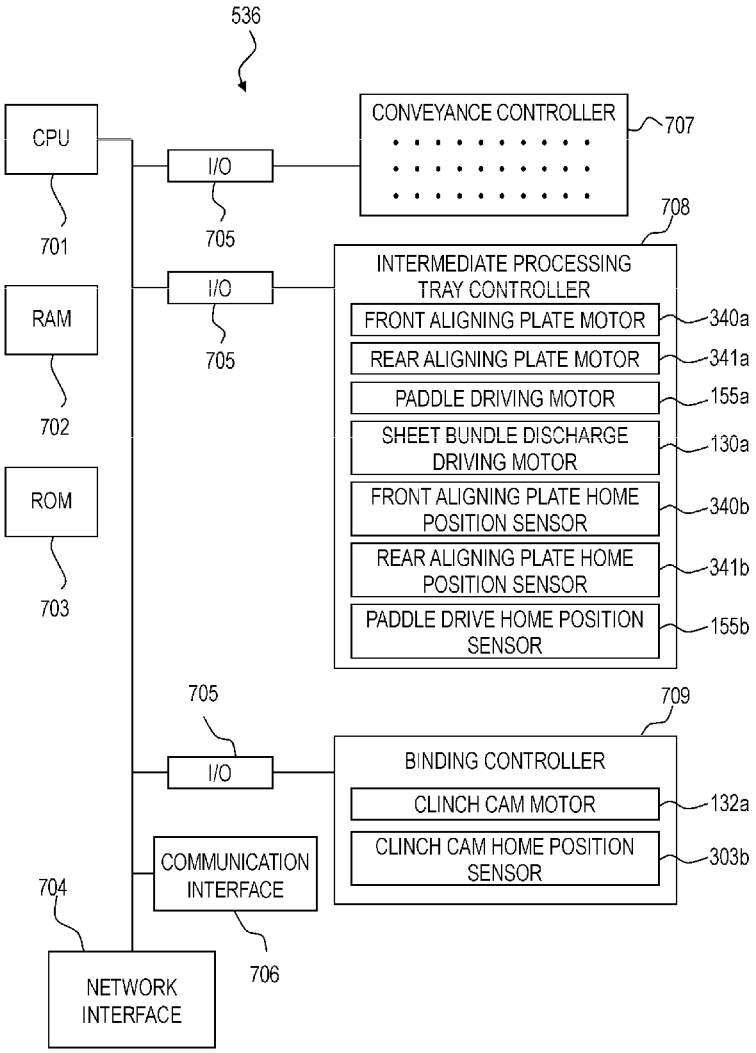
FIG. 4 is a block diagram showing a configuration of a control system of the finisher.

FIG. 4 is a block diagram showing a configuration of the finisher controller 536 which controls the finisher 100, in the embodiment. The finisher controller 536 includes a microcomputer including a CPU 701, a RAM 702, a ROM 703, an input/output portion (I/O) 705, a communication interface 706, and a network interface 704.

The input/output portion (I/O) 705 is connected to a conveyance controller 707, an intermediate processing tray controller 708, and a binding controller 709. The conveyance controller 707 controls the lateral registration detecting process, the sheet buffering process, the conveyance process, and the like, of the sheet 1. The intermediate processing tray controller 708 controls driving of a front aligning plate motor 340*a*, a rear aligning plate motor 341*a*, a paddle driving motor 155*a*, and a sheet bundle discharge driving motor 130*a*.

A front aligning plate home position sensor 340*b*, a rear aligning plate home position sensor 341*b*, and a paddle drive home position sensor 155*b* are connected to the intermediate processing tray controller 708. The intermediate processing tray controller 708 controls operations of a front aligning plate 340 and a rear aligning plate 341 shown in FIG. 6. The front aligning plate 340 and the rear aligning plate 341 serve as the aligning portion which aligns the sheet 1 on the intermediate processing tray 138 (on the intermediate stacking portion). The intermediate processing tray controller 708 also controls an operation of a drawing paddle 131 shown in FIG. 7. Further, the intermediate processing tray controller 708 controls opening/closing of a swing guide 149 shown in FIG. 5.

The intermediate processing tray controller 708 performs the above mentioned controls by means of the front aligning plate home position sensor 340*b*, the rear aligning plate home position sensor 341*b*, and the paddle drive home position sensor 155*b*, as well as the front aligning plate motor 340*a*, the rear aligning plate motor 341*a*, the paddle driving motor 155*a*, and the sheet bundle discharge driving motor 130*a*. Furthermore, a clinch cam motor 132*a* and a clinch cam home position sensor 303*b* are connected to the binding controller 709.

<Binding Process Portion>

Figure 5:
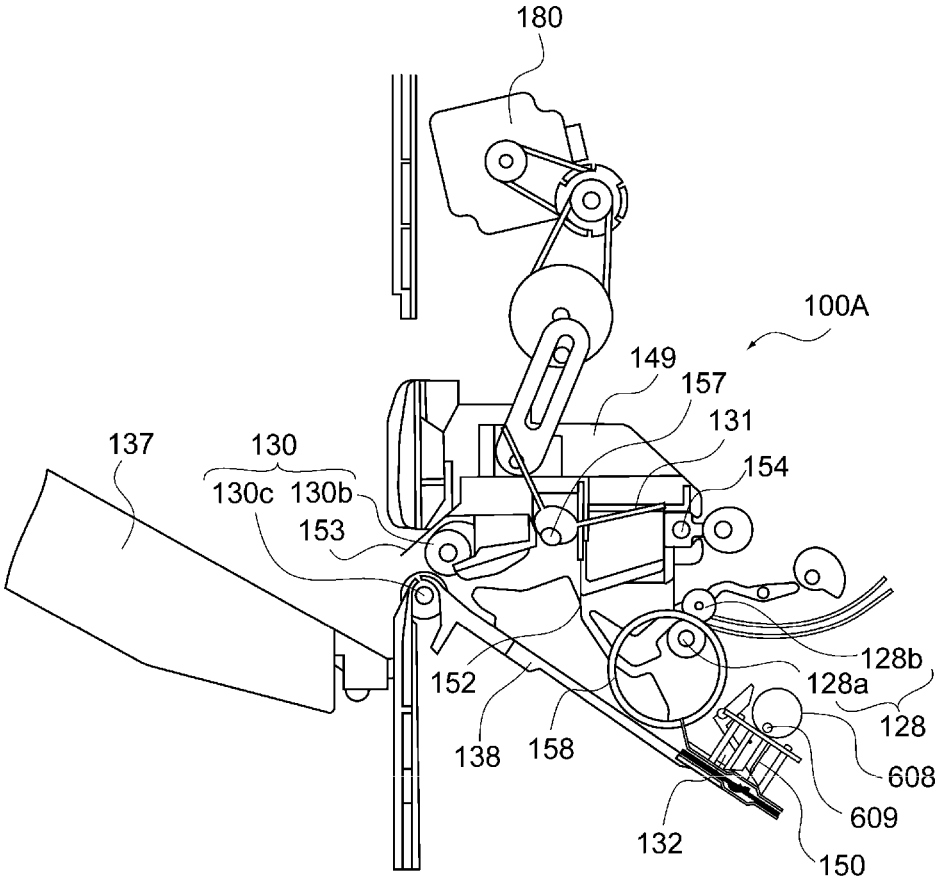
FIG. 5 is an explanatory sectional view showing a configuration of an intermediate stacking portion placed in the finisher.

The following is a description of a configuration of the binding process portion including the intermediate processing tray 138, with reference to FIG. 5. As shown in FIG. 5, the intermediate processing tray 138 is placed so as to incline in such a manner that the downstream side (left side on FIG. 5) in the discharge direction of the sheet bundle 1*n* is higher than the upstream side (right side on FIG. 5). A rear end stopper 150 is placed in the lower end part or the upstream side of the intermediate processing tray 138. The intermediate processing tray 138 may be placed horizontally.

Figure 6:
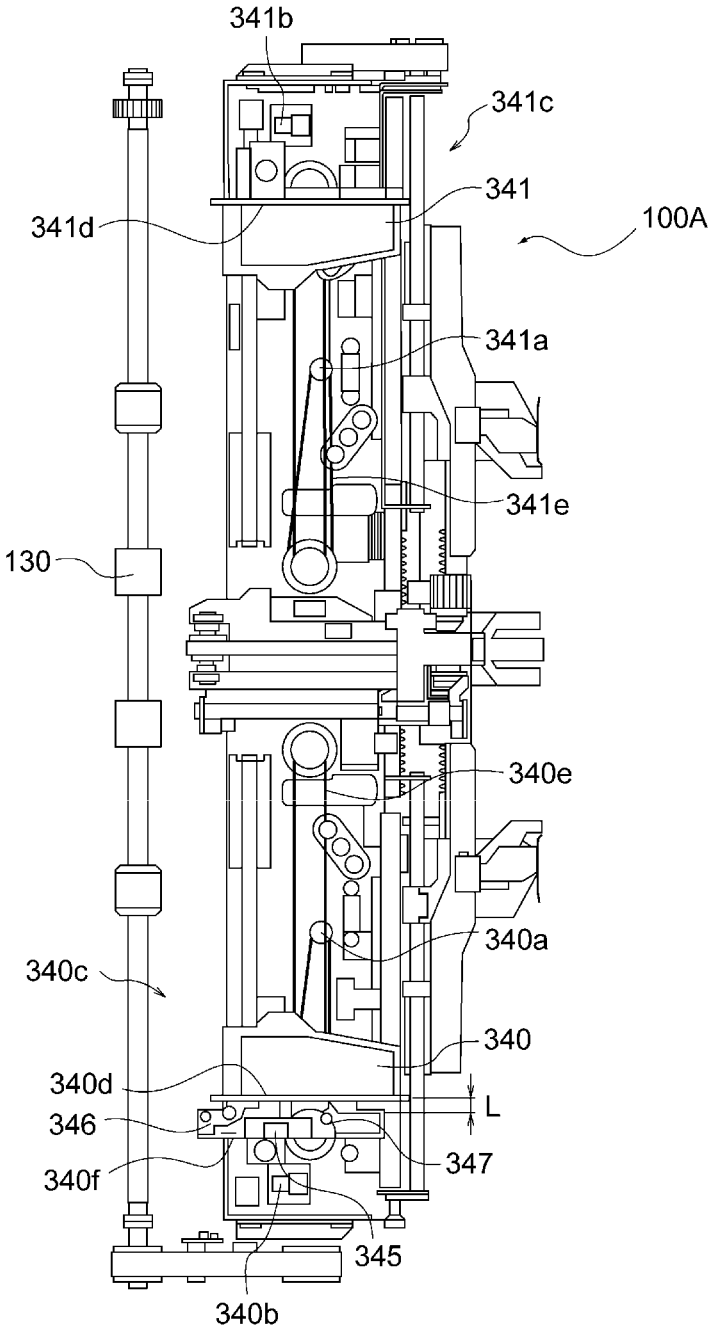
FIG. 6 is an explanatory plan view showing a configuration of an aligning portion placed in the intermediate stacking portion.
Figure 14:
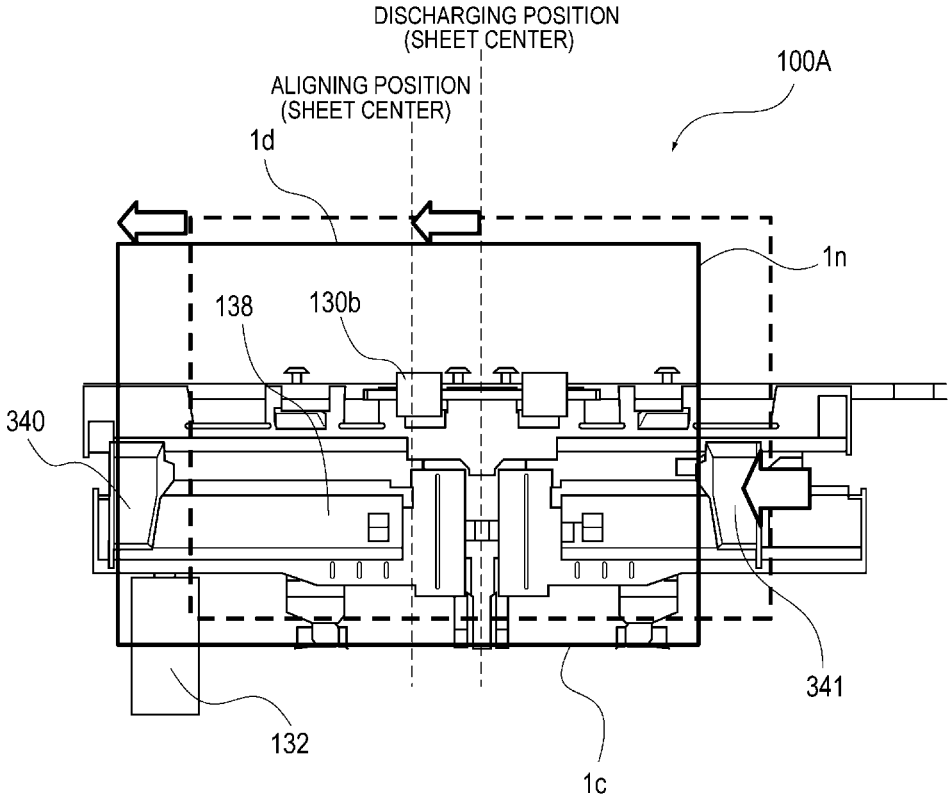
FIG. 14 is an explanatory front view illustrating a flow of a sheet in non-sorting automatic binding.

As shown in FIGS. 5 and 6, a front aligning portion 340*c* and a rear aligning portion 341*c* are placed in the middle part of the intermediate processing tray 138. In addition, as shown in FIG. 14, the intermediate processing tray 138 has a side edge regulating portion which regulates positions of both side edges 1*c*, 1*d* in the width direction of the sheet 1 discharged to the intermediate processing tray 138.

The front aligning portion 340*c* and the rear aligning portion 341*c* have the front aligning plate 340 and the rear aligning plate 341, respectively. The front aligning plate 340 and the rear aligning plate 341 have an aligning portion 340*d*, 341*d*, respectively. The aligning portion 340*d*, 341*d* forms an aligning surface. Furthermore, the front aligning portion 340*c* and the rear aligning portion 341*c* include a front aligning plate motor 340*a* and a rear aligning plate motor 341*a*, respectively, which drive separately the front aligning plate 340 and the rear aligning plate 341, respectively.

Positions of both side edges of the sheet 1 are regulated in the following manner. The drive motions of the front aligning plate motor 340*a* and the rear aligning plate motor 341*a* are transmitted, through timing belts 340*e*, 341*e*, to the front aligning plate motor 340 and the rear aligning plate motor 341, respectively. The timing belts 340*e*, 341*e* form a moving portion together with the front aligning plate motor 340*a* and the rear aligning plate motor 341*a*.

As a result, the front aligning plate 340 and the rear aligning plate 341 move independently along the width direction of the intermediate processing tray 138. The front and the rear aligning plates 340, 341 align the sheet 1 by abutting the both side edges of the sheet 1 placed on the intermediate processing tray 138.

More specifically, the front aligning plate 340 and the rear aligning plate 341 are disposed on the intermediate processing tray 138 such that the aligning portions (aligning surfaces) 340*d*, 341*d* face each other. Moreover, the front and the rear aligning plates 340, 341 are attached to the intermediate processing tray 138 so as to be movable both forward and backward in the alignment direction or the vertical direction of FIG. 6.

With this configuration, even if the sheet 1 (or the sheet bundle 1*n*) is conveyed unaligned widthwise, the sheet 1 (or the sheet bundle 1*n*) on the intermediate processing tray 138 is placed in a correct position widthwise by the front aligning plate 340 and the rear aligning plate 341.

For example, the aligning portion 340*d* which forms the aligning surface of the front aligning plate 340 is placed movably in the width direction of the sheet 1. The width direction corresponds to the vertical direction of FIG. 6. A tension spring 345 is placed between the aligning portion 340*d* and an apparatus frame 340*f* of the front aligning plate 340.

The tension spring 345 and a moving link 346, 347 cause the aligning portion 340*d* to project by a predetermined distance L to the sheet 1 side. As described below, in order to regulate the side edge position of the sheet 1, when the aligning portion 340*d* presses the sheet 1, the aligning portion 340*d* serving as a pressing portion moves toward the apparatus frame 340*f* while resisting the tension spring 345.

The front aligning plate home position sensor 340*b* and the rear aligning plate home position sensor 341*b* are shown in FIG. 6. The front aligning plate home position sensor 340*b* and the rear aligning plate home position sensor 341*b* detect home positions of the front aligning plate 340 and the rear aligning plate 341, respectively.

With the front aligning plate home position sensor 340*b* and the rear aligning plate home position sensor 341*b*, the front aligning plate 340 and the rear aligning plate 341 are able to stand by at home positions thereof, when the finisher 100 is not in operation. The home positions are outer end positions of the front aligning plate 340 and the rear aligning plate 341.

Figure 7:
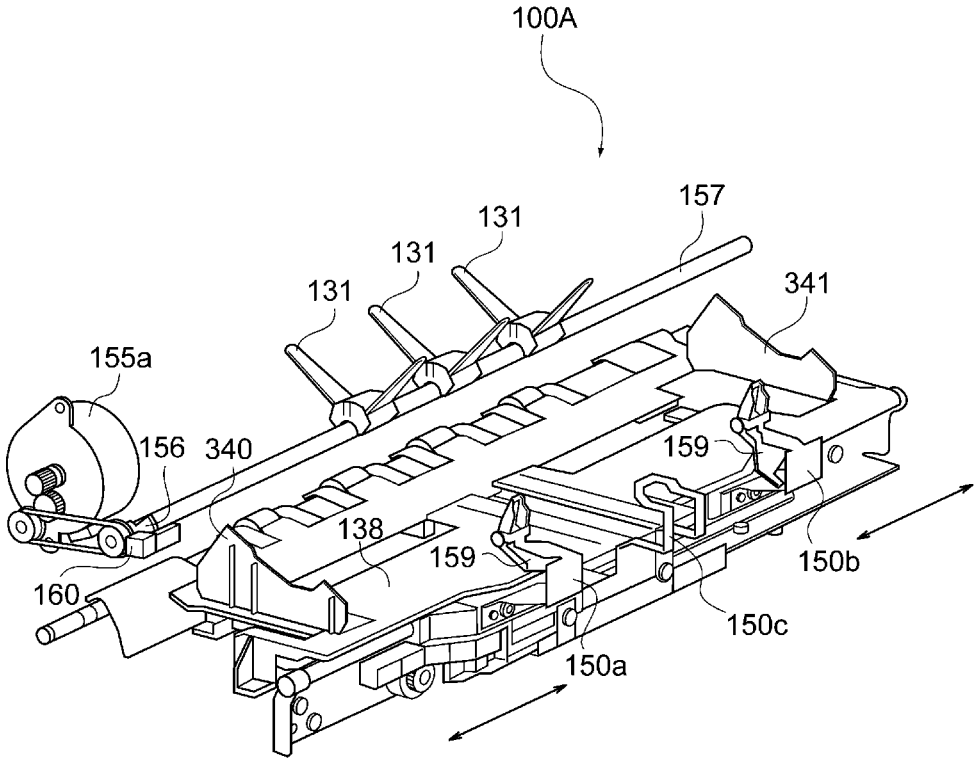
FIG. 7 is an explanatory perspective view showing a configuration of the intermediate stacking portion.
Figure 13A:
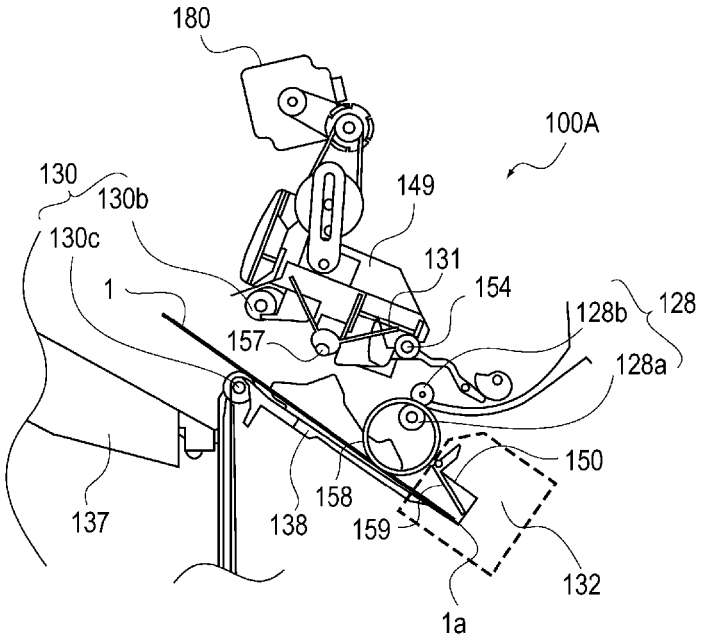
FIG. 13A is an explanatory sectional view illustrating a flow of a sheet in non-sorting automatic binding.

The drawing paddle 131 shown in FIG. 7 and the swing guide 149 shown in FIG. 13A are placed in the downstream side in the drawing direction of the intermediate processing tray 138, which corresponds to the upper end part on FIG. 5. The drawing paddle 131 shown in FIG. 7 is placed in the upper side of the intermediate processing tray 138. A plurality of the drawing paddles 131 is fixed along a driving shaft 157 shown in FIG. 7. The driving shaft 157 is rotated by a paddle driving motor 155*a*. The drawing paddle 131 shown in FIG. 7 rotates around the driving shaft 157 counterclockwise on FIG. 5. The drawing paddle 131 is rotated by the paddle driving motor 155*a* with a proper timing.

The sheet 1 is nipped and discharged by rollers 128*a*, 128*b* shown in FIG. 5, which form a pair of lower discharge rollers 128. As a result of the inclination of the intermediate processing tray 138 and the rotation of the drawing paddle 131, the sheet 1 slides down on a stacking surface of the intermediate processing tray 138, or on another sheet 1 which has already been placed on the intermediate processing tray 138.

The sheet 1 which has slid down as described above is conveyed by the belt roller 158 serving as the sheet conveying portion, which rotates in the counterclockwise direction on FIG. 5, until the rear end part 1*a* (an upstream end in the discharge direction) of the sheet 1 hits the rear end stopper 150 which serves as a stopper. Then the sheet 1 stops.

As shown in FIG. 5, the belt roller 158 is placed above the intermediate processing tray 138 in such a manner that the lower part thereof is in contact with the uppermost sheet 1 placed on the intermediate processing tray 138. The belt roller 158 is suspended on the outer circumference of the roller 128*a* which forms the pair of lower discharge rollers 128. The belt roller 158 rotates counterclockwise on FIG. 5, driven by the rotation of the roller 128*a*.

The swing guide 149 forming a sheet discharging portion rotatably holds an upper part discharge roller 130*b*. The upper part discharge roller 130*b* forms a pair of sheet bundle discharge rollers 130 shown in FIG. 3, together with a lower part discharge roller 130*c*. The lower part discharge roller 130*c* is placed at the downstream end of the intermediate processing tray 138.

As the swing guide 149 swings in the vertical direction on FIG. 5, the upper part discharge roller 130*b* touches/leaves the lower part discharge roller 130*c*. The pair of sheet bundle discharge rollers 130 (for example, the lower part discharge roller 130*c*) is rotated forward/backward by the sheet bundle discharge driving motor 130*a* mentioned in FIG. 4.

The swing guide 149 serves as a holding member to hold the upper part discharge roller 130*b* which is one of the pair of sheet bundle discharge rollers 130. The swing guide 149 swings in the vertical direction on FIG. 5, driven by a swing guide opening/closing motor 180. A supporting shaft 154 serves as a fulcrum of the swing guide 149.

Normally, when the sheet 1 is discharged to the intermediate processing tray 138, the swing guide 149 swings upward on FIG. 5, with the supporting shaft 154 as a fulcrum. Accordingly, the upper part discharge roller 130*b* is separated from the lower part discharge roller 130*c* which is the other one of the pair of sheet bundle discharge rollers 130. In other words, the pair of the sheet bundle discharge rollers 130 are in an open state.

When processing of the sheet 1 on the intermediate processing tray 138 is finished, the swing guide 149 swings downward on FIG. 5, with the supporting shaft 154 as the fulcrum, so that the upper part discharge roller 130*b* and the lower part discharge roller 130*c* nip the sheet bundle 1*n*. Then, the pair of sheet bundle discharge rollers 130 rotate, with the sheet bundle 1*n* nipped by the upper part discharge roller 130*b* and the lower part discharge roller 130*c*. As a result, the sheet bundle 1*n* is discharged to the lower tray 137.

As shown in FIG. 5, in the swing guide 149, a first destaticizing needle 152 is placed along the axial direction of the driving shaft 157. The first destaticizing needle 152 removes surface charge on the sheet 1, when the sheet 1 is discharged from the pair of lower discharge rollers 128 into the intermediate processing tray 138.

Furthermore, in the swing guide 149, a second destaticizing needle 153 is placed along the axial direction of the driving shaft 157. The second destaticizing needle 153 removes surface charge on the sheet 1 discharged from the pair of sheet bundle discharge rollers 130. The second destaticizing needle 153 is located in the downstream side of the upper part discharge roller 130*b*.

<Binding Portion>

A stapler 132 serving as the binding portion binds an end of the sheet bundle 1*n*, driven by the clinch cam motor 132*a* mentioned in FIG. 4. The stapler 132 is fixed on the intermediate processing tray 138.

The stapler 132 performs binding in a corner of the sheet bundle 1*n* placed on the intermediate processing tray 138.

The front aligning plate 340 and the rear aligning plate 341 shown in FIG. 6 move the sheet 1 in the width direction such that the stapler 132 fixed on the intermediate processing tray 138 and a part to be stapled of the sheet bundle 1*n* are in the same position, whereby the stapler 132 is able to bind the sheet bundle 1*n* in different sizes.

<Stapleless Binding Portion>

Figure 8:
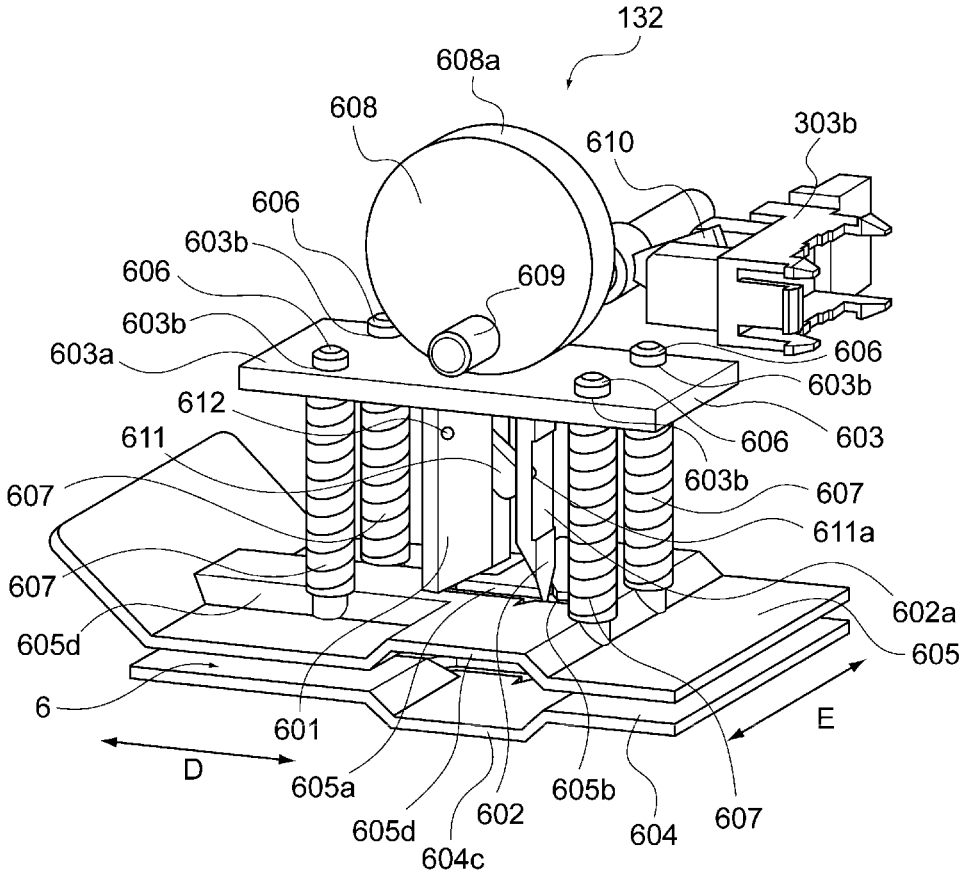
FIG. 8 is an explanatory perspective view showing a configuration of a stapleless binding portion.
Figure 9A:
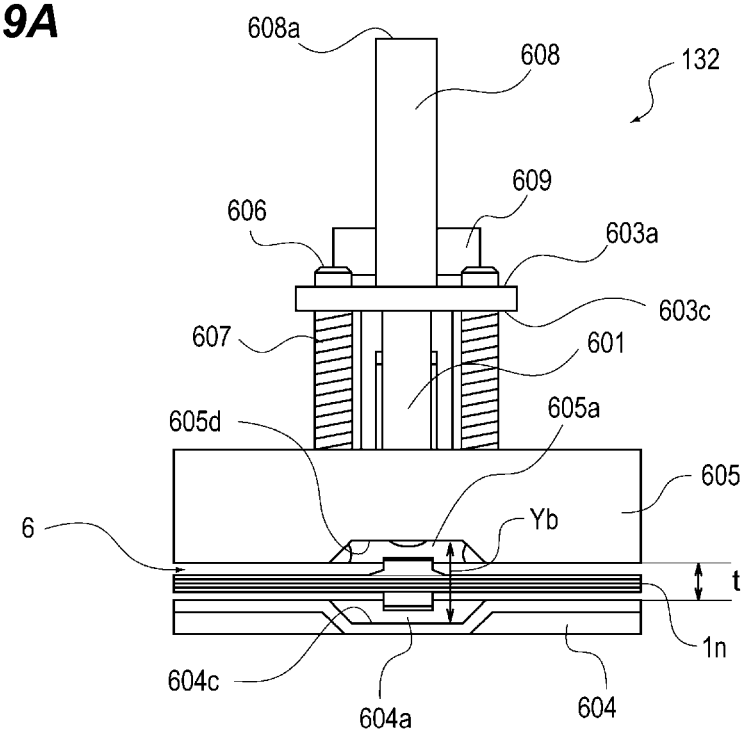
FIG. 9A is a left side view showing a configuration of the stapleless binding portion.
Figure 9B:
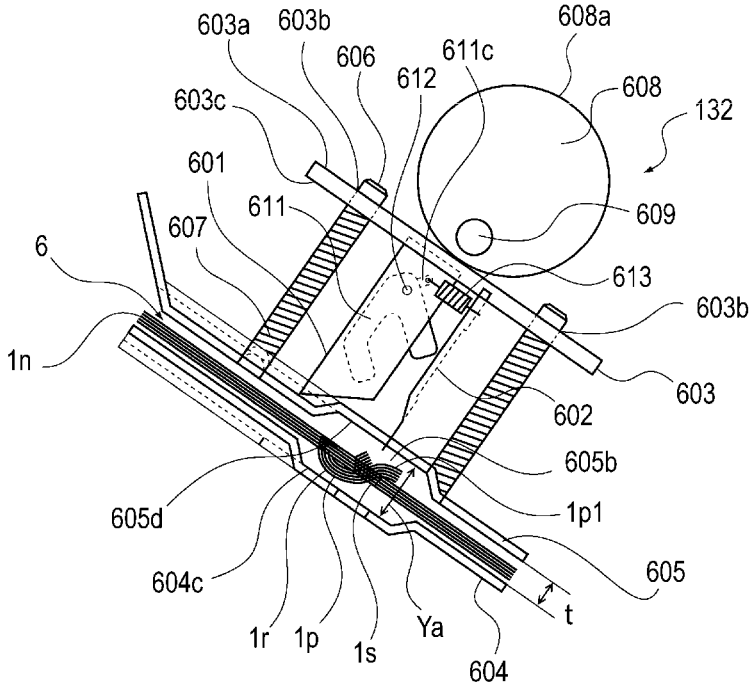
FIG. 9B is an explanatory front view showing a configuration of the stapleless binding portion.

Next, a configuration of the stapler 132 is described with reference to FIGS. 8-11. FIG. 8 is an explanatory perspective view showing the configuration of the stapler 132. FIG. 9A is a left side view showing the configuration of the stapler 132. FIG. 9B is an explanatory front view showing the configuration of the stapler 132. FIGS. 10A, 10B, 11A, and 11B are explanatory sectional views illustrating a motion of the stapler 132.

Figure 10A:
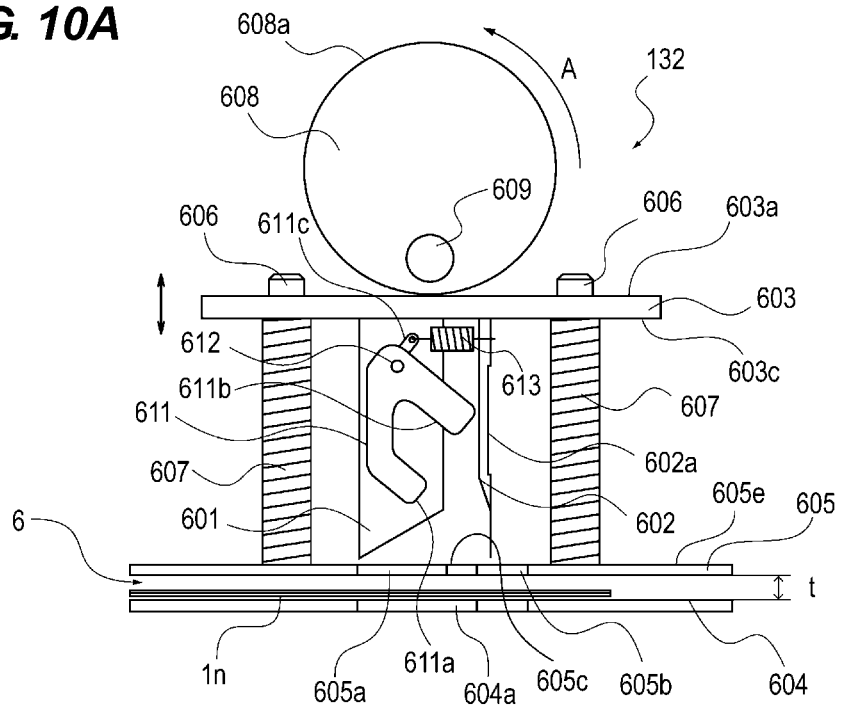
FIG. 10A is an explanatory sectional view illustrating a motion of the stapleless binding portion.

As shown in FIGS. 8, 9A and 9B, a half-blanking punch 601 is placed in the stapler 132. The half-blanking punch 601 forms, in the sheet bundle in, a half-blanked tongue 1*p* shown in FIG. 10B. The half-blanking punch 601 is fixed to a punch holder 603. In addition, a slit punch 602 shown in FIG. 10A is fixed to the punch holder 603. The slit punch 602 makes a slit is into which a tip 1*p*1 of the half-blanked tongue 1*p* formed by the half-blanking punch 601 is inserted.

The stapler 132 serving as the binding portion, in the sheet bundle 1*n* placed on the intermediate processing tray 138 (on the intermediate stacking portion), forms a half-blanked tongue 1*p* in each of the sheets 1 forming the sheet bundle 1*n*. Such half-blanked tongue 1*p* is formed by cutting with the half-blanking punch 601, with a part of the tongue attached to each of the sheets 1. Further, the slit is 1*s* made in each of the sheets 1. The slit is 1*s* formed of a through hole cut by the slit punch 602. Then, the tips 1*p*1 of the half-blanked tongues 1*p* of the sheet bundle 1*n* are inserted integrally into the slits 1*s*, as a unit, of the sheet bundle 1*n*. As a result, the sheet bundle 1*n* is bound at the end thereof.

As shown in FIG. 10A, a die 604 is fixed to an apparatus frame (not shown) so as to face the punch holder 603 which is movable in the vertical direction on FIG. 10A. A series of through holes 604*a* is formed in the die 604. The half-blanking punch 601 and the slit punch 602 pass through the through holes 604*a*.

A slide supporting plate 605 is placed between the punch holder 603 and the die 604, with a gap t in which the sheet bundle 1*n* is contained. The slide supporting plate 605 is fixed to the apparatus frame (not shown).

A plurality of slide shafts 606 is erected on an upper surface 605*e* of the slide supporting plate 605. The punch holder 603 has a through hole 603*b* through which the slide shaft 606 is movably inserted. As a result, the punch holder 603 is configured to be able to slide along the slide shaft 606 in the vertical direction on FIG. 10A.

A compression spring 607 is fitted to the outer periphery of the slide shaft 606. The compression spring 607 has the inside diameter larger than the outside diameter of the slide shaft 606. The compression spring 607 is placed between the lower surface 603*c* of the punch holder 603 and the upper surface 605*e* of the slide supporting plate 605, coaxially with the slide shaft 606. With this configuration, lifting force in the upward direction on FIG. 10A, caused by extension force of the compression spring 607, acts constantly on the punch holder 603.

In the upper direction on FIG. 10A from the punch holder 603, an eccentric cam 608 is placed so as to be in contact with the upper surface 603*a* of the punch holder 603. The eccentric cam rotates around a cam shaft 609. A clinch cam motor 132*a* mentioned in FIG. 4 is provided in the vicinity of the cam shaft 609 of the eccentric cam 608. The clinch cam motor 132*a* serves as a drive source for rotating the eccentric cam 608.

The eccentric cam 608 rotates around the cam shaft 609 by the rotary drive of the clinch cam motor 132*a*. As a result, a cam surface 608*a* in a longer diameter part of the eccentric cam 608 presses the upper surface 603*a* of the punch holder 603 in the lower direction on FIG. 10A, resisting the extension force of the compression spring 607. When the cam surface 608*a* in a shorter diameter part of the eccentric cam 608 abuts the upper surface 603*a* of the punch holder 603, the punch holder 603 retracts in the upper direction on FIG. 10A, by the extension force of the compression spring 607. With this configuration, the punch holder 603 is able to lift and lower as desired in the vertical direction on FIG. 10A, according to the rotation of the eccentric cam 608.

As shown in FIG. 8, a cam home position flag 610 is attached to the cam shaft 609 of the eccentric cam 608. In addition, a clinch cam home position sensor 303*b* is provided, in order to detect the location of the cam home position flag 610.

In the embodiment, when the punch holder 603 is in the upper position on FIG. 8, or when the half-blanking punch 601 and the slit punch 602 retract and separate from a sheet bundle holding portion 6 formed between the slide supporting plate 605 and the die 604, the punch holder 603, the half-blanking punch 601, and the slit punch 602 are located in the home positions thereof.

The slide supporting plate 605 has through holes 605*a* and 605*b* through which the half-blanking punch 601 and the slit punch 602 are able to pass, respectively.

The half-blanking punch 601 forms the half-blanked tongue 1*p* in the sheet bundle 1*n*. Therefore, a cutting blade of the half-blanking punch 601 viewed from the direction along which the punch holder 603 slides (the vertical direction on FIG. 8) has a U-shaped sectional shape, which corresponds to a U-shape of a cutout part 1*u* of the half-blanked tongue 1*p* shown in FIG. 12.

Figure 10B:
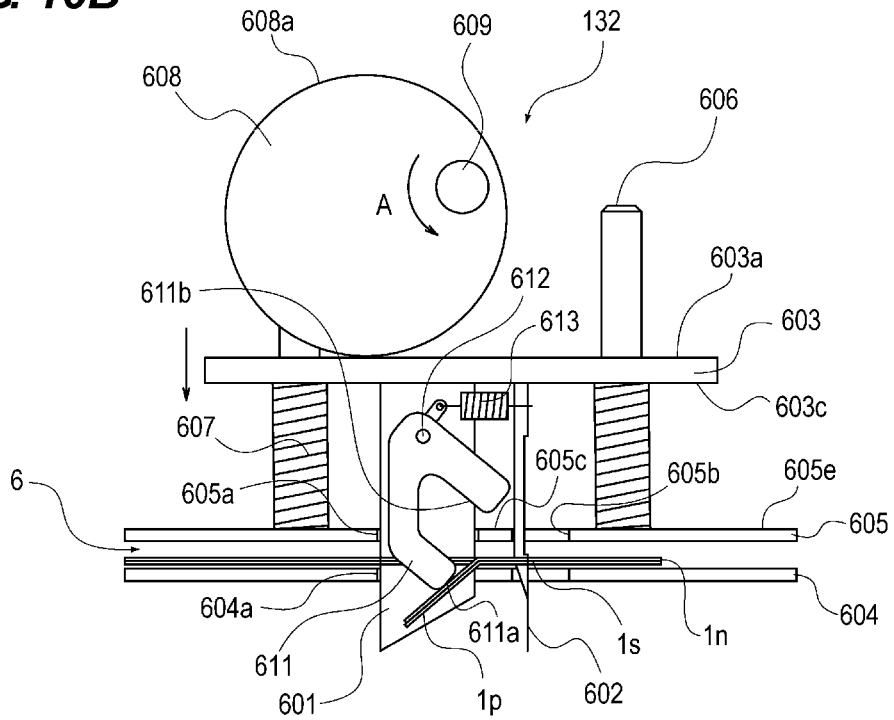
FIG. 10B is an explanatory sectional view illustrating a motion of the stapleless binding portion.

As shown in FIGS. 8 and 10B, a C-shaped folding lever 611 is placed inside the cutting blade of the half-blanking punch 601. The folding lever 611 turns around the lever turning shaft 612. The folding lever 611 folds the half-blanked tongue 1*p* shown in FIG. 10B, which has been formed by the half-blanking punch 601, to the slit is side.

Figure 11A:
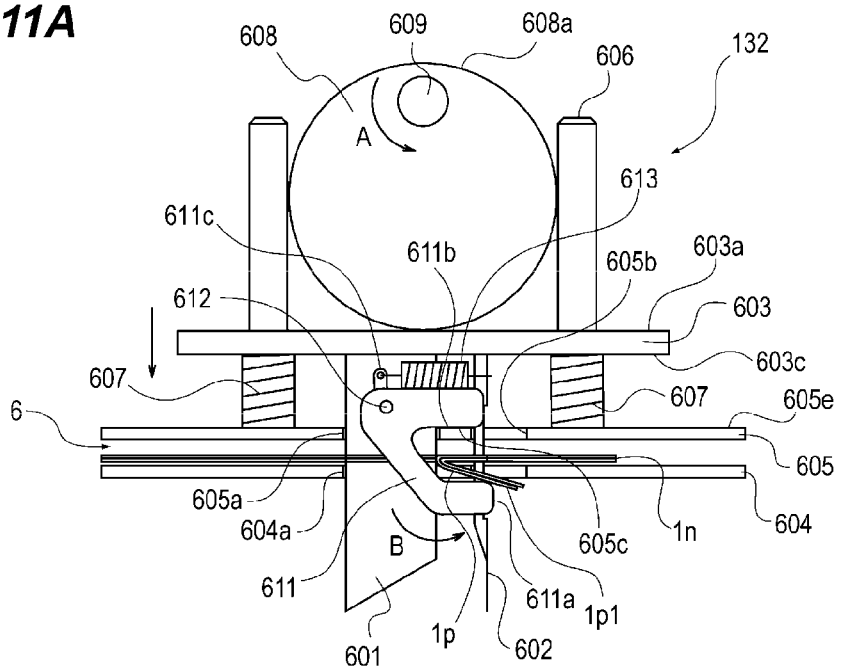
FIG. 11A is an explanatory sectional view illustrating a motion of the stapleless binding portion.

As shown in FIGS. 8 and 11A, the slit punch 602 has a through hole 602*a*. A tongue pushing surface 611*a* of the folding lever 611 and the tip 1*p*1 of the half-blanked tongue 1*p* pass through the through hole 602*a*, when the folding lever 611 turns around the lever turning shaft 612.

As shown in FIG. 10A, a hooking portion 611*c* is provided in the folding lever 611. The hooking portion 611*c* is placed in an upper position on FIG. 10A from the turning center of the lever turning shaft 612 of the folding lever 611. One end of the tension spring 613 is locked to the hooking portion 611*c*. The other end of the tension spring 613 is locked to the slit punch 602. Therefore, the folding lever 611 and the slit punch 602 are engaged with each other via the tension spring 613.

In FIG. 10A, the cam surface 608*a* in the shorter diameter part of the eccentric cam 608 abuts the upper surface 603*a* of the punch holder 603, and the punch holder 603 retracts in the upper direction on FIG. 10A by the extension force of the compression spring 607. Therefore, the punch holder 603 is in its home position. At this time, the tongue pushing surface 611*a* of the folding lever 611 is always housed and kept inside the cutting blade of the half-blanking punch 601.

On the other hand, in FIG. 11A, a cam surface 608*a* in the longer diameter part of the eccentric cam 608 presses the upper surface 603*a* of the punch holder 603, resisting the extension force of the compression spring 607. The punch holder 603 moves in the downward direction on FIG. 11A, and reaches the lowest position as shown in FIG. 11A. At this time, the folding lever 611 turns around the lever turning shaft 612 in the counterclockwise direction on FIG. 11A. Then the tongue pushing surface 611*a* passes through the through hole 602*a* shown in FIG. 8 to project from the slit punch 602.

The folding lever 611 has an abutting surface 611*b* which abuts an abutting surface 605*c* of the slide supporting plate 605. As shown in FIG. 11A, when the punch holder 603 lowers to the lowest position, the abutting surface 611*b* of the folding lever 611 abuts the abutting surface 605*c* located between the two through holes 605*a* and 605*b* formed in the slide supporting plate 605. With this configuration, the folding lever 611 turns around the lever turning shaft 612 in the counterclockwise direction on FIG. 11A, then the tongue pushing surface 611*a* passes through the through hole 602*a* shown in FIG. 8, to project from the slit punch 602.

Details of motions for forming the half-blanked tongue 1*p* to be formed in the sheet bundle 1*n* by cutting with the half-blanking punch 601, and for folding and inserting the half-blanked tongue 1*p* into the slit is formed by cutting with the slit punch 602 will be described later.

As shown in FIGS. 9A and 9B, the die 604 and the slide supporting plate 605 have recessed parts 604*c* and 605*d*, respectively. Each of the recessed parts 604*c*, 605*d* extends in a plurality of different directions starting from the half-blanking punch 601 and the slit punch 602. The recessed parts 604*c*, 605*d* have a gap Ya, Yb in between. Distance of the gap Ya, Yb is larger than that of the gap t between flat parts formed in end parts of both of the die 604 and the slide supporting plate 605.

As shown in FIG. 8, the recessed parts 604*c*, 605*d* are formed in the die 604 and the slide supporting plate 605 which act as guide faces of the stapler 132 serving as the binding portion. The recessed parts 604*c*, 605*d* extend in different directions from each other. At least one of the plurality of recessed parts 604*c*, 605*d* extending in different directions from each other is formed in either of the die 604 or the slide supporting plate 605 which acts as guide faces of the stapler 132 serving as the binding portion.

The recessed part 604*c*, 605*d* of the embodiment extends in a plurality of different directions (in orthogonal directions, in the embodiment) from a binding point of the sheet bundle 1*n*. At least one of the recessed part 604*c* and the recessed part 605*d*, which extends in a plurality of different directions (in orthogonal directions, in the embodiment) from the binding point of the sheet bundle 1*n*, is formed in one of the guide faces (either one of the die 604 and the slide supporting plate 605).

In the embodiment, each of the recessed parts 604*c*, 605*d* formed in the die 604 and the slide supporting plate 605, respectively, extends from the half-blanking punch 601 and the slit punch 602, in the direction toward the lower tray 137 serving as a stacking portion shown in FIG. 3 (in the direction indicated by an arrow Din FIG. 8). Also, each of the recessed parts 604*c*, 605*d* extends in a direction perpendicular to the direction toward the lower tray 137 (in the direction indicated by an arrow E in FIG. 8).

After a binding process of the sheet bundle 1*n* by the stapler 132 serving as the binding portion, there are at least two directions in which the sheet bundle 1*n* having been bound moves from an opening formed of the gap t between the slide supporting plate 605 and the die 604 of the stapler 132.

Additionally, the die 604 and the slide supporting plate 605 can each have the recessed part 604*c*, 605*d* which is not shown but extends in at least two radial directions from the half-blanking punch 601 and the slit punch 602. Thereby, the stapler 132 is configured such that the sheet bundle 1*n* having been bound moves in at least two directions from the opening formed of the gap t between the slide supporting plate 605 and the die 604 of the stapler 132.

Figure 12:
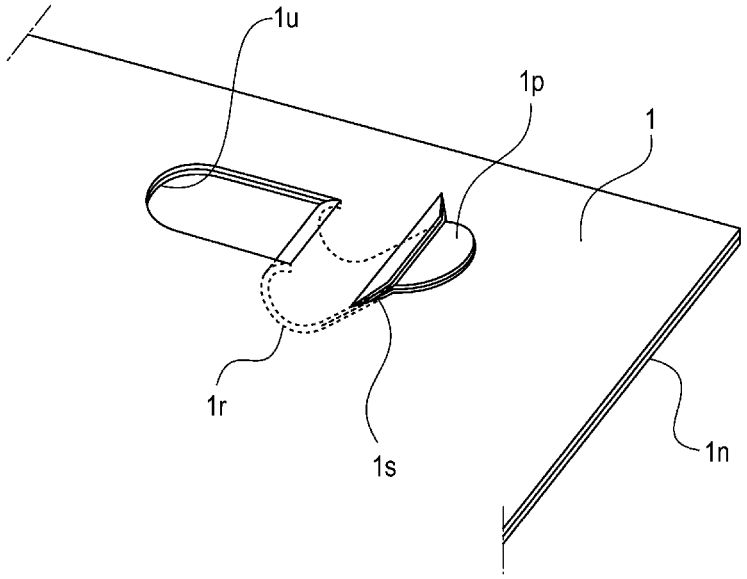
FIG. 12 is an explanatory perspective view showing a sheet bundle bound by a stapleless binding process.

With this configuration, after a stapleless binding process of the sheet bundle 1*n*, an insertion-fastening part 1*r* which partially protrudes from a sheet surface 1*n*1 of the sheet bundle 1*n* as shown in FIG. 12 and the guide faces of the die 604 and the slide supporting plate 605 do not interfere with each other. Therefore, the insertion-fastening part 1*r* partially protruding from a sheet surface 1*n*1 easily passes through the recessed part 604*c*, 605*d* extending linearly from the half-blanking punch 601 and the slit punch 602. This enables the sheet bundle 1*n* having been binding-processed to move easily along the recessed part 604*c*, 605*d*.

Figure 20A:
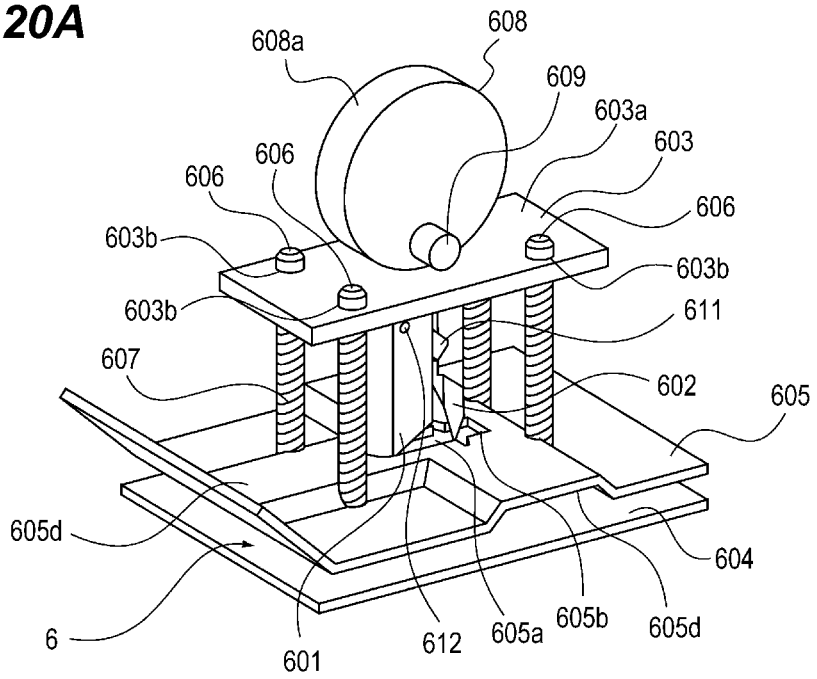
FIG. 20A is an explanatory perspective view showing a different configuration of the stapleless binding portion.
Figure 20B:
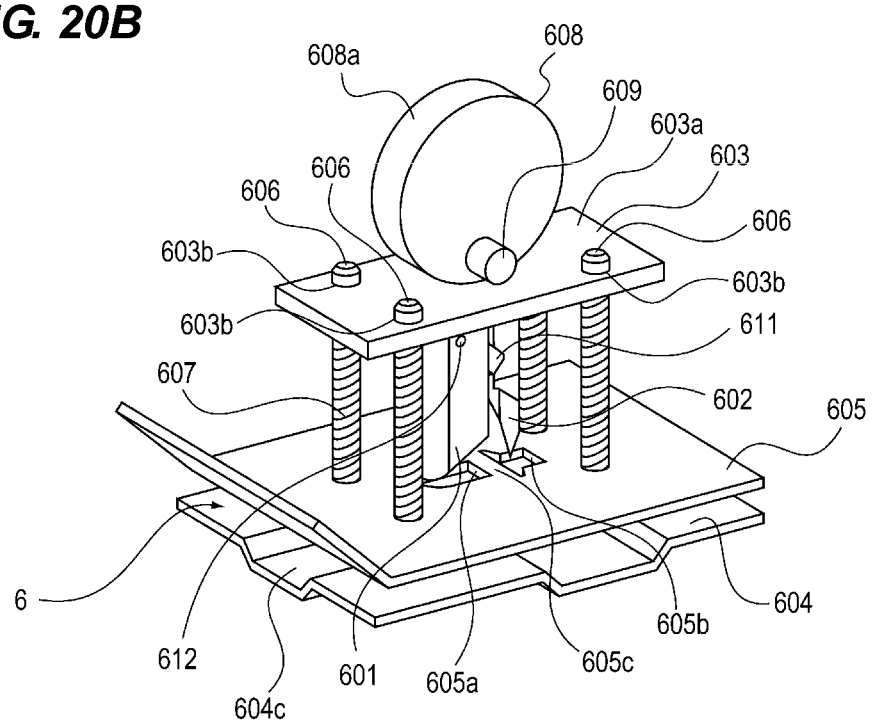
FIG. 20B is an explanatory perspective view showing another different configuration of the stapleless binding portion.

As shown in FIGS. 8, 20A, and 20B, the recessed part 604*c*, 605*d* formed in the die 604 and the slide supporting plate 605 is formed so as to extend in a direction in which the sheet bundle 1*n* is conveyed, that is, in the direction toward the lower tray 137 serving as the stacking portion, as indicated by the arrow D in FIG. 8. The recessed part 604*c*, 605*d* is also formed so as to extend in the width direction of the sheet bundle 1*n*, that is, in a direction perpendicular to the direction in which the sheet bundle 1*n* is conveyed, as indicated by the arrow E in FIG. 8.

On the other hand, a flat part is formed in the end part of each of the die 604 and the slide supporting plate 605. As shown in FIGS. 9A and 9B, the distance of the gap t between the flat parts of the die 604 and the slide supporting plate 605 is smaller than the gap Ya, Yb of the recessed part 604*c*, 605*d*. With such flat part, the thickness of the sheet bundle in is limited so as to prevent the sheet bundle 1*n* interposed between the die 604 and the slide supporting plate 605 from increasing in thickness beyond the processing capacity of the stapler 132.

<Stapleless Binding Operation>

A stapleless binding operation on the sheet bundle 1*n* with the stapler 132 is described below with reference to FIGS. 10A, 10B, 11A, and 11B. As shown in FIG. 10A, the sheet bundle in is stored in the sheet bundle holding portion 6 in the stapler 132. The sheet bundle holding portion 6 is formed of the flat parts with the gap t between the die 604 and the slide supporting plate 605. Subsequently, the eccentric cam 608 shown in FIG. 10A rotates around the cam shaft 609 in the direction indicated by an arrow A in FIG. 10A. The eccentric cam 608 is rotated by rotary drive of the clinch cam motor 132*a* mentioned in FIG. 4.

As the eccentric cam 608 rotates in the direction indicated by an arrow A in FIG. 10B, the punch holder 603 including the half-blanking punch 601 and the slit punch 602 is pressed by the cam surface 608*a* of the eccentric cam 608, resisting the extension force of the compression spring 607, and lowers as shown in FIG. 10B. As a result, the half-blanked tongue 1*p* is formed in the sheet bundle 1*n* stored in the sheet bundle holding portion 6, by cutting with the half-blanking punch 601. Likewise, the slit 1*s* is formed by cutting with the slit punch 602.

Next, as shown in FIG. 10B, tongue pushing surface 611*a* of the folding lever 611 abuts the half-blanked tongue 1*p* cut out by the half-blanking punch 601 and begins to fold the half-blanked tongue 1*p* to the slit is side.

The eccentric cam 608 rotates around the cam shaft 609 further in the direction indicated by an arrow A shown in FIG. 11A, and the punch holder 603 reaches near the lowest position thereof, as shown in FIG. 11A. As a result, the abutting surface 611*b* of the folding lever 611 and the abutting surface 605*c* of the slide supporting plate 605 contact each other.

Then, the folding lever 611 turns around the lever turning shaft 612 in the direction indicated by an arrow B shown in FIG. 11A, resisting a tensile force of the tension spring 613 engaged between the hooking portion 611*c* of the folding lever 611 and the slit punch 602.

Further, the tongue pushing surface 611*a* of the folding lever 611 pushes the half-blanked tongue 1*p* of the sheet bundle 1*n* upward on FIG. 11A. Then, the tip 1*p*1 of the half-blanked tongue 1*p* passes through the through hole 602*a* shown in FIG. 8, formed in the slit punch 602, to project to the right on FIG. 8.

Figure 11B:
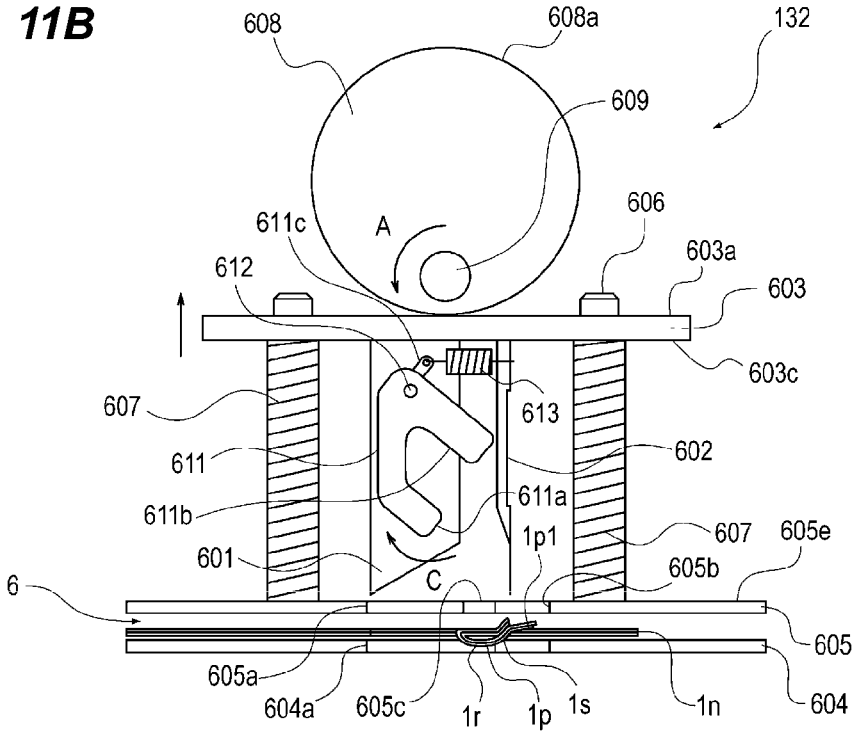
FIG. 11B is an explanatory sectional view illustrating a motion of the stapleless binding portion.

As the eccentric cam 608 further rotates around the cam shaft 609 in the direction indicated by the arrow A shown in FIG. 11A, the punch holder 603 is pushed in the upward direction on FIG. 11B by the extension force of the compression spring 607, as shown in FIG. 11B.

Then, the folding lever 611 turns around the lever turning shaft 612 in the direction indicated by an arrow C shown in FIG. 11B, by the tensile force of the tension spring 613. Accordingly, the abutting surface 611*b* of the folding lever 611 and the abutting surface 605*c* of the slide supporting plate 605 are separated from each other. As a result, the tongue pushing surface 611*a* of the folding lever 611 leaves the through hole 602*a* formed in the slit punch 602 shown in FIG. 8 and retracts to the left on FIG. 8.

Also, as shown in FIG. 11A, the punch holder 603 moves in the upward direction on FIG. 11B. At this time, the tip 1*p*1 of the half-blanked tongue 1*p* of the sheet bundle in, having been cut out by the half-blanking punch 601, is inserted in the through hole 602*a* formed in the slit punch 602 shown in FIG. 8.

The tip 1*p*1 of the half-blanked tongue 1*p* having been inserted in the through hole 602*a* formed in the slit punch 602 lifts integrally with the slit punch 602 which moves in the upward direction on FIG. 11B. The tip 1*p*1 then passes through the slit is of the sheet bundle 1*n* formed by cutting with the slit punch 602, and moves to the upper surface side of the sheet bundle 1*n* as shown in FIG. 11B.

As a result, as shown in FIG. 11B, the half-blanked tongue 1*p* of the sheet bundle 1*n* is folded to be inserted in the slit is, so that the sheet bundle 1*n* is fastened and bound as a unit. After that, when the eccentric cam 608 rotates to the home position thereof shown in FIG. 10A, the clinch cam motor 132*a* mentioned in FIG. 4 stops, completing the stapleless binding operation by the stapler 132 on the sheet bundle 1*n*.

As described above, by the stapleless binding, the sheet bundle 1*n* formed of a plurality of sheets 1 is bound to be a single unit of the sheet bundle in, with the tip 1*p*1 of the half-blanked tongue 1*p* folded and inserted in the slit is of the sheet bundle in, as shown in FIG. 12.

<Sheet Conveying Motion>

The following is a description of the motion of the finisher 100 when conveying the sheet 1 at the time of stapleless binding process, with reference to FIGS. 13A to 19.

<Automatic Binding>

The embodiment has an automatic binding mode. In the automatic binding, the sheet bundle 1*n* is binding-processed by the stapling portion 100A. The stapling portion 100A serves as the binding portion which binds the sheet bundle 1*n* formed of the sheets 1 stacked on the intermediate processing tray 138 (on the intermediate stacking portion). The sheet 1 is conveyed by the conveying path 126 serving as the conveying portion shown in FIG. 3, to be placed on the intermediate processing tray 138.

In the automatic binding, after the binding process by the stapling portion 100A serving as the binding portion, the sheet bundle 1*n* is conveyed in the following direction: The sheet bundle 1*n* which has been binding-processed is conveyed by the pair of sheet bundle discharge rollers 130 serving as the discharging portion, from the opening formed between the die 604 and the slide supporting plate 605 in the stapling portion 100A to the lower tray 137 serving as the stacking portion.

<Non-Sorting Automatic Binding>

Figure 13B:
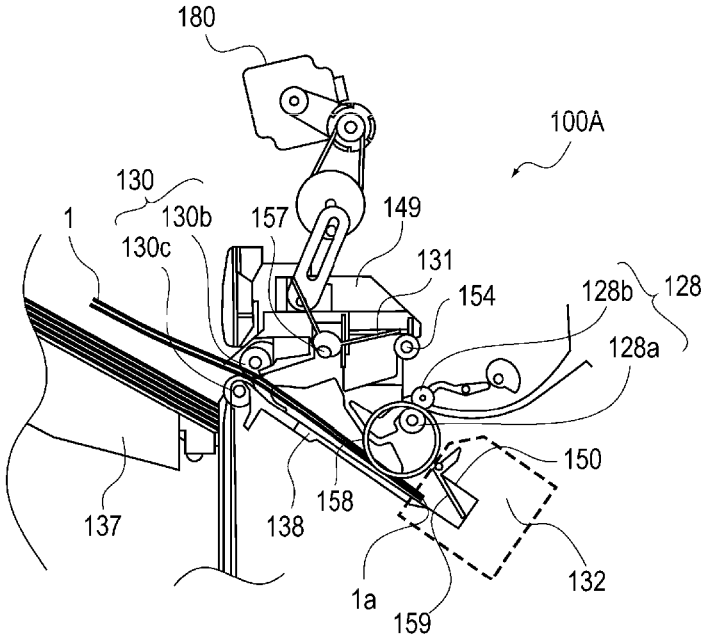
FIG. 13B is an explanatory sectional view illustrating a flow of a sheet in non-sorting automatic binding.
Figure 15A:
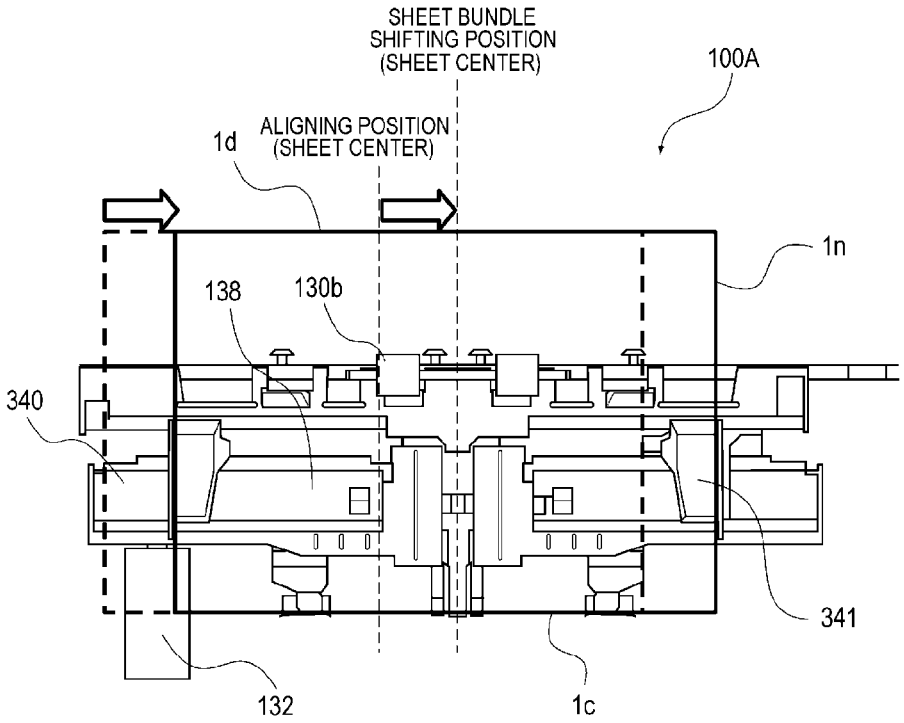
FIG. 15A is an explanatory front view illustrating a flow of a sheet in automatic binding with sorting.
Figure 18:
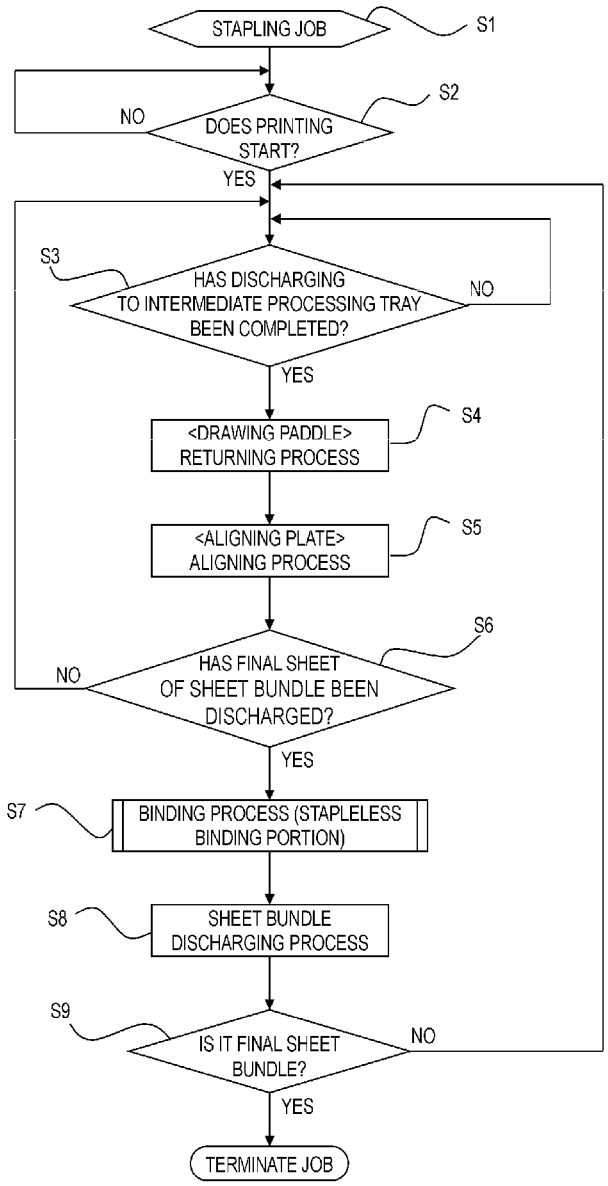
FIG. 18 is a flowchart illustrating control of a binding process.

The motion of the finisher 100 in non-sorting automatic binding is described below, with reference to FIGS. 13A to 15A. FIGS. 13A and 13B are explanatory sectional views showing the motion of the stapling portion 100A. FIGS. 14 and 15A are explanatory plan views showing the motion of the stapling portion 100A. FIG. 18 is a flowchart illustrating the motion of the stapling portion 100A in non-sorting automatic binding.

In step S1 in FIG. 18, a non-sorting automatic binding job is selected in the operation portion 501 shown in FIG. 1. Then, the image forming apparatus 502 starts a print job to form a toner image on the sheet 1 (step S2).

The sheet 1, having been discharged from the body of the image forming apparatus 502 by the discharge roller 907, passes through the conveying paths in the finisher 100, before the rear end part 1*a* of the sheet 1 passes through a nipping part of the pair of lower discharge rollers 128. Then the sheet 1 is discharged to the intermediate processing tray 138, as shown in FIG. 13A (step S3).

Subsequently, in step S4, the drawing paddle 131 rotates around the driving shaft 157 in the counterclockwise direction on FIG. 13A. In this process, the drawing paddle 131 conveys the sheet 1 so as to return the rear end part 1*a* of the sheet 1 in the direction of the rear end stopper 150.

The sheet 1 having been conveyed in the direction of the rear end stopper 150 is drawn further to the side of the rear end stopper 150 by the belt roller 158 which rotates in the counterclockwise direction on FIG. 13A. Then, the rear end part 1*a* of the sheet 1 jogs the rear end stopper 150, so that the sheet 1 can be aligned.

The rear end part 1*a* of the sheet 1 is aligned so as to align the sheet 1 in the direction in which the sheet 1 is conveyed. After finishing the alignment of the rear end part 1*a* on the intermediate processing tray 138, the front and rear aligning plates 340 and 341 serving as the aligning portion, shown in FIG. 14, shift and align the sheet 1 in the width direction, in step S5. The width direction is perpendicular to the direction in which the sheet 1 is conveyed.

As shown in FIG. 14, the front and rear aligning plates 340 and 341 align the sheet 1 placed on the intermediate processing tray 138, shifting the sheet 1 so that a side edge of the sheet 1 in the width direction corresponds to the stapling position of the stapler 132.

The aforementioned series of sheet 1 aligning motions is repeated to every succeeding sheet 1 discharged to the intermediate processing tray 138, until the final sheet 1 of the sheet bundle 1*n* is discharged from the pair of lower discharge rollers 128 to the intermediate processing tray 138, in step S6.

When the final sheet 1 of the sheet bundle 1*n* is discharged to the intermediate processing tray 138 and the sheet 1 aligning motion is completed, the stapler 132 binds the sheet bundle 1*n*, in step S7, such that a corner on one side of the sheet bundle 1*n* is stapled.

In step S8, as shown in FIG. 13B, the swing guide 149 lowers so that the sheet bundle 1*n* can be nipped by the upper part discharge roller 130*b* and the lower part discharge roller 130*c* which form the pair of sheet bundle discharge rollers 130 serving as the discharging portion. The sheet bundle 1*n* is conveyed by the discharge rollers 130*b* and 130*c*, to be discharged to the lower tray 137.

The above motion is repeated to a specified number of the sheet bundles 1*n*. When the binding process of the final sheet bundle 1*n* is finished in step S9, the non-sorting automatic binding job terminates.

<Automatic Binding with Sorting>

Figure 15B:
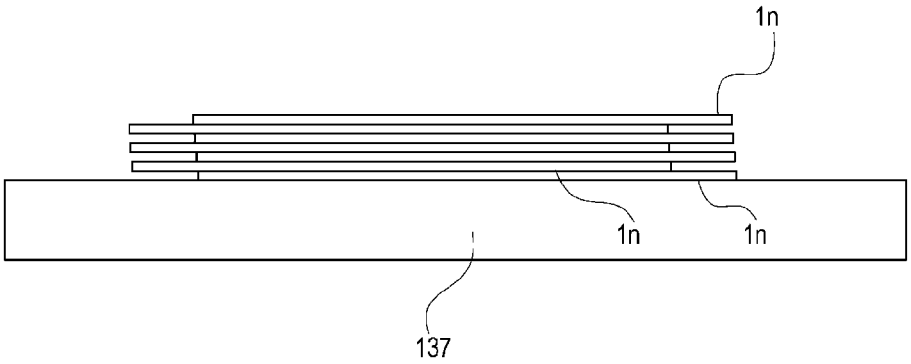
FIG. 15B is an explanatory front view showing sheet bundles stacked in alternate positions on the stacking portion.
Figure 19:
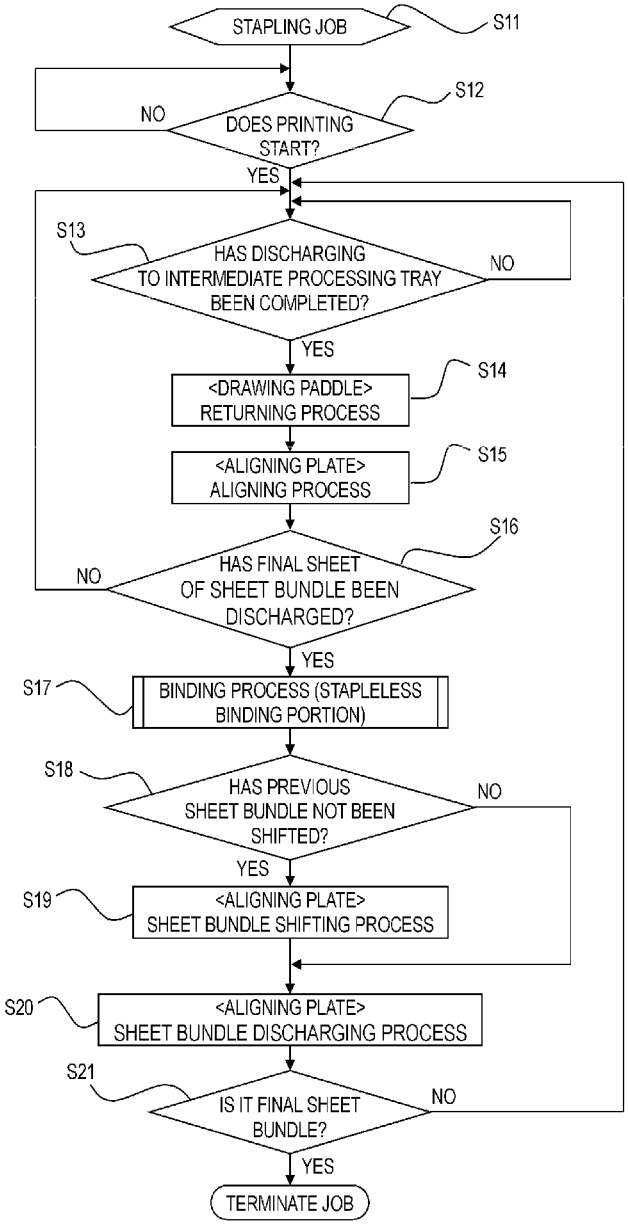
FIG. 19 is a flowchart illustrating control of another binding process.

The motion of the finisher 100 in automatic binding with sorting is described below, with reference to FIGS. 15A, 15B and 19. FIG. 15A is an explanatory plan view showing the motion of the stapling portion 100A. FIG. 15B is an explanatory front view showing the sheet bundles 1*n* stacked on the lower tray 137 in alternate positions. FIG. 19 is a flowchart illustrating the motion of the stapling portion 100A in the automatic binding with sorting.

As mentioned in steps S11-S17 in FIG. 19, the sheet 1 having been discharged from the body of the image forming apparatus 502 shown in FIG. 1 is discharged to the intermediate processing tray 138. The sheet 1 is shifted to be aligned in such a manner that the end of the sheet 1 corresponds to the stapling position of the stapler 132. The stapler 132 then binds the sheet bundle 1*n* such that a corner on one side of the sheet bundle 1*n* is stapled. The above series of motions is controlled similarly to the motions in the non-sorting automatic binding described previously with reference to steps S1-S7 in FIG. 18 and FIGS. 13A and 13B, and will not be repeatedly described.

In step S17 in FIG. 19, the binding process of the sheet bundle 1*n* by the stapler 132 is completed. If the previous sheet bundle 1*n* has not shifted position in step S18, the operation proceeds to step S19. In step S19, as shown in FIG. 15A, the front aligning plate 340 shifts the sheet bundle 1*n* as a whole in the rear direction. Subsequently, the swing guide 149 shown in FIG. 13B lowers so that the sheet bundle 1*n* can be nipped and conveyed by the upper part discharge roller 130*b* and the lower part discharge roller 130*c*, and the sheet bundle 1*n* is discharged to the lower tray 137 (step S20).

The process for binding the subsequent sheet bundle 1*n* is completed by the stapler 132 in a similar fashion to the non-sorting automatic binding. In this case, the sheet bundle 1*n* is not shifted when the binding process is finished. Then the swing guide 149 lowers so that the sheet bundle 1*n* can be nipped and conveyed by the upper part discharge roller 130*b* and the lower part discharge roller 130*c*, and the sheet bundle 1*n* is discharged to the lower tray 137.

The embodiment has a sheet bundle sorting mode. The sheet bundle sorting mode enables the sheet bundle 1*n* which has been binding-processed to move in the rear direction of the body of the finisher 100 (the body of the sheet processing apparatus). The rear direction is perpendicular to the direction toward the lower tray 137 serving as the stacking portion. The binding-processed sheet bundle 1*n* is moved from the opening formed between the die 604 and the slide supporting plate 605 in the stapling portion 100A serving as the binding portion, by means of the pair of sheet bundle discharge rollers 130 serving as the discharging portion.

The above motion for shifting the binding-processed sheet bundle 1*n* is performed on every other sheet bundle 1*n*. As a result, as shown in FIG. 15B, the sheet bundles 1*n* are stacked on the lower tray 137 in alternate positions. In other words, a preceding binding-processed sheet bundle 1*n* and a succeeding binding-processed sheet bundle 1*n* are discharged to the lower tray 137 in shifted positions.

This prevents the insertion-fastening part 1*r* of the sheet bundle 1*n* shown in FIG. 12 from being placed on top of each other on the lower tray 137, which, as a result, reduces the total thickness of the binding-processed sheet bundles 1*n* stacked on the lower tray 137. When the binding process of the final sheet bundle 1*n* is finished in step S21, the job of the automatic binding with sorting terminates.

<Manual Binding>

The embodiment has a manual binding mode, which enables the sheet bundle 1*n* placed on the intermediate processing tray 138 to be binding-processed by the stapling portion 100A serving as the binding portion. In the manual binding, the sheet bundle 1*n* is able to be placed on the intermediate processing tray 138 (on the intermediate stacking portion) manually (by a user) from a direction different from the direction in which the sheet 1 is conveyed by the conveying path 126 serving as the conveying portion shown in FIG. 3.

Figure 16:
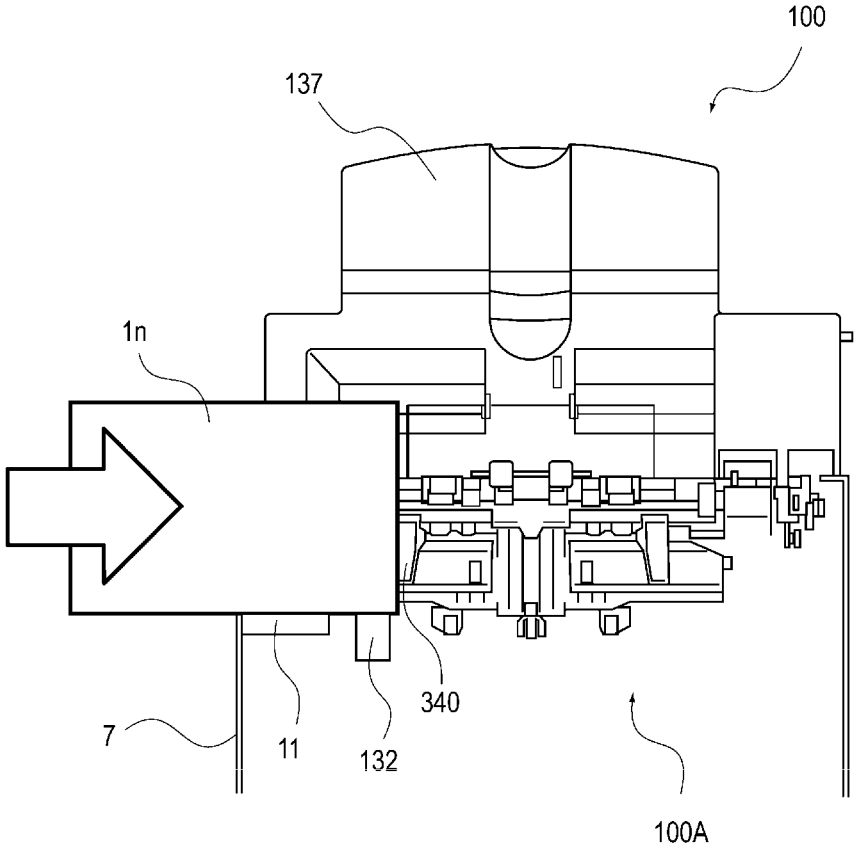
FIG. 16 is an explanatory plan view illustrating a motion of a finisher in manual binding.
Figure 17:
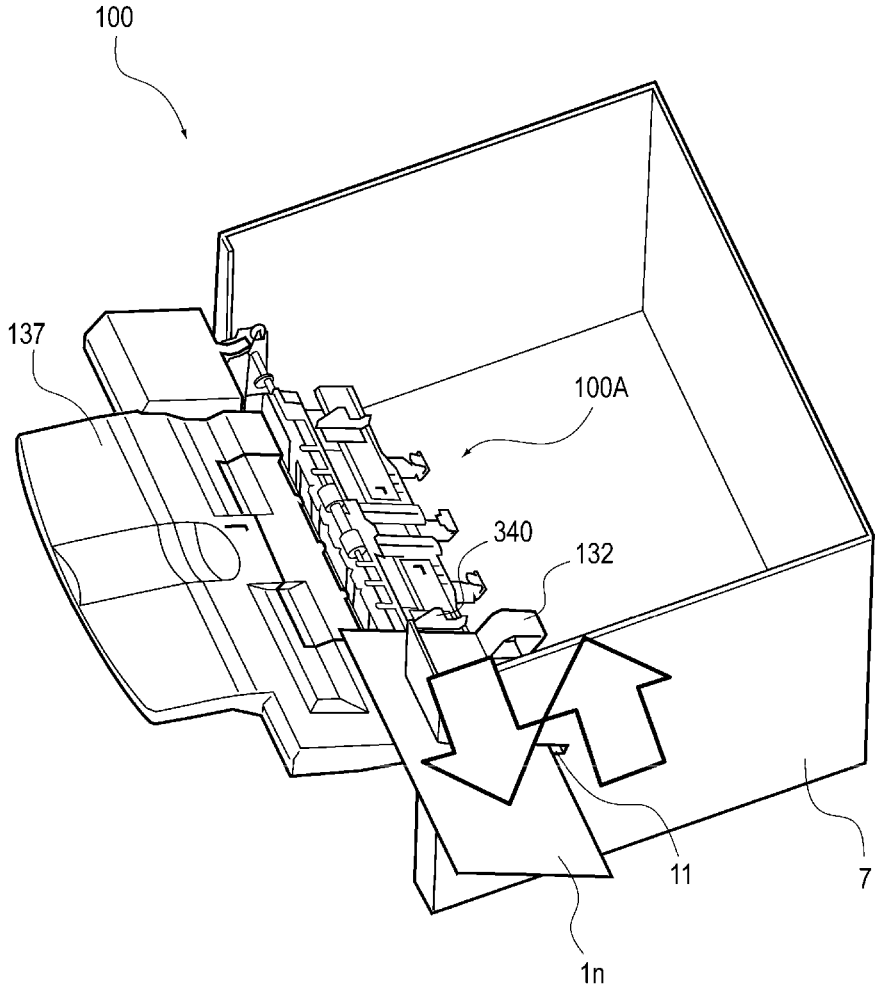
FIG. 17 is an explanatory perspective view illustrating a motion of a finisher in manual binding.

In manual binding in the embodiment, as shown in FIGS. 16 and 17, the binding-processed sheet bundle 1*n* is able to be moved manually (by a user) from the opening formed between the die 604 and the slide supporting plate 605 in the stapling portion 100A serving as the binding portion. The binding-processed sheet bundle 1*n* is able to be moved in the front direction of the body of the finisher 100 (the body of the sheet processing apparatus). The front direction is perpendicular to the direction toward the lower tray 137 serving as the stacking portion.

The stapling portion 100A serving as the binding portion of the embodiment is situated on the front side of the body of the finisher 100 (the body of the sheet processing apparatus). The stapling portion 100A is located in the same position as in both the manual binding and the automatic binding described earlier.

The motion of the finisher 100 in the manual binding is described below, with reference to FIGS. 16 and 17. FIG. 16 is an explanatory plan view showing a configuration of the stapling portion 100A. FIG. 17 is an explanatory perspective view showing the configuration of the stapling portion 100A.

When the manual binding mode is selected in the operation portion 501 shown in FIG. 1, the front aligning plate 340, first, moves to the manual binding position. As shown in FIGS. 16 and 17, a sheet bundle 1*n* which a user wishes to have binding-processed is inserted in a slit 11 formed on an outer cover 7 from the front side of the body of the finisher 100.

In the manual binding in the embodiment, an outer back surface of the front aligning plate 340 functions as described below. The front aligning plate 340 serving as the aligning portion is placed on the front side of the body of the finisher 100 (the body of the sheet processing apparatus), and is shifted in advance.

The sheet bundle 1*n* is inserted in the slit 11. The outer back surface of the front aligning plate 340 acts as an abutting guide (a stopper) which obstructs the sheet bundle 1*n*. The outer back surface of the front aligning plate 340 is located at the back, in the direction in which the sheet bundle 1*n* is inserted, of the opening formed between the die 604 and the slide supporting plate 605 in the stapling portion 100A serving as the binding portion. The sheet bundle 1*n* insertion direction is perpendicular to the direction toward the lower tray 137 serving as the stacking portion. With this configuration, the position of the sheet bundle 1*n* is fixed prior to the binding process.

When the "binding process" button is pressed through the operation portion 501 shown in FIG. 1, the binding process is performed on the corner on one side of the sheet bundle 1*n*. The binding-processed sheet bundle 1*n* is removed by the user, in the direction opposite to the direction in which the sheet bundle 1*n* is inserted in the slit 11 before the binding process is performed.

This completes the binding job in the manual binding. When the next binding process is performed following the previous one, the insertion of the sheet bundle 1*n* and the sheet bundle 1*n* binding process are repeated in the same fashion. In this way, a plurality of the sheet bundles in is able to be binding-processed continuously.

Again, the configuration of the die 604 and the slide supporting plate 605 in the stapler 132 will be described. The tip 1*p*1 of the half-blanked tongue 1*p* formed by cutting the sheet bundle 1*n* with the half-blanking punch 601 is folded so as to turn over. Then, the tip 1*p*1 is inserted in the slit is formed by cutting the sheet bundle 1*n* with the slit punch 602.

After the sheet bundle 1*n* binding process, the insertion-fastening part 1*r* is formed, which partially projects outward from the sheet surface 1*n*1 of the sheet bundle 1*n*. The recessed part 604*c*, 605*d* is formed in the die 604 and the slide supporting plate 605, respectively. The recessed part 604*c*, 605*d* extends from the insertion-fastening part 1*r*, in both the direction toward the lower tray 137 and the width direction of the sheet 1.

This configuration prevents the insertion-fastening part 1*r*, which partially projects from the sheet surface 1*n*1 as a result of the sheet bundle 1*n* binding process, from getting stuck between the die 604 and the slide supporting plate 605 which serves as the lower and upper guides for the binding-processed sheet bundle in, when the sheet bundle in moves. The recessed part 604*c*, 605*d* enables the insertion-fastening part 1*r*, which partially projects from the sheet surface 1*n*1 as a result of the sheet bundle 1*n* binding process, to easily pass therethrough.

This facilitates the shifting motion in which the binding-processed sheet bundle 1*n* is conveyed in the direction toward the lower tray 137. Moreover, this also facilitates the shifting motion in which the sheet bundle 1*n* is conveyed in the width direction (in the horizontal direction on FIG. 15B) of the sheet bundle 1*n* for the purpose of stacking a plurality of the sheet bundles 1*n* on the lower tray 137 in alternate positions as shown in FIG. 15B.

Furthermore, as shown in FIGS. 16 and 17, in the manual binding by a user, it is easy to move the binding-processed sheet bundle 1*n* in the front direction of the finisher 100. Therefore, the binding-processed sheet bundle 1*n* is able to be moved in a plurality of different directions easily.

With the above configuration, it is not necessary to turn and transfer the stapler 132 in order to remove the binding-processed sheet bundle 1*n* more easily. Also, increases in size and cost of the finisher 100 are avoided, without the need to transfer the lower tray 137 for shift-stacking the sheet bundles 1*n*. As a result, the finisher 100 with a simplified configuration is obtained, which enables manual binding and shift-stacking in the stapleless binding.

In the embodiment, the stapler 132 is fixed while the binding-processed sheet bundle 1*n* is moved. However, a similar effect is produced, with a configuration in which the stapler 132 moves with respect to the sheet bundle 1*n*, as a method to remove the sheet bundle 1*n* from the stapler 132.

In the embodiment, the binding-processed sheet bundle 1*n* is able to be moved with respect to the stapler 132. Therefore, the sheet bundle 1*n* is able to have either a single or more than one binding point, changing the binding position thereof.

In the stapler 132 of the embodiment, the recessed parts 604*c* and 605*d* are formed in both of the die 604 and the slide supporting plate 605, respectively, to increase the space through which the insertion-fastening part 1*r* of the sheet bundle 1*n* passes. Alternatively, as shown in FIGS. 20A and 20B, either one of the die 604 and the slide supporting plate 605 has a recessed part 604*c*, 605*d* as appropriate, to obtain a similar effect.

In the embodiment, the cutout-insertion-type stapleless binding portion performs the automatic binding process and the manual binding process. Either of the processes can be selected, depending on the needs of a user.

Also in the embodiment, with the stapler 132 serving as the binding portion, the automatic binding process and the manual binding process are performed. The moving direction of the binding-processed sheet bundle 1*n* in each of the processes is as follows: In the automatic binding, the binding-processed sheet bundle 1*n* is conveyed from the opening in the stapler 132 to the lower tray 137. In the manual binding, the binding-processed sheet bundle 1*n* is able to be moved from the opening in the stapler 132 in the front direction of the body of the sheet processing apparatus. The front direction is perpendicular to the direction toward the lower tray 137.

In addition, sorting of the sheet bundle 1*n* can be selected. In the sorting, the binding-processed sheet bundle 1*n* is able to be moved from the opening in the stapler 132 in the rear direction of the body of the sheet processing apparatus. The rear direction is perpendicular to the direction toward the lower tray 137. The above-mentioned processes are performed selectively. As a consequence, the sheet processing apparatus is provided, which achieves both quality improvement such as operation performance, sorting performance, and multiple binding, and quality assurance such as damage prevention properties, without increasing the size and cost of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-093864, filed Apr. 30, 2014, which is hereby incorporated by reference herein in its entirety.

What is claimed is:

1. A sheet processing apparatus comprising:

a first stacking portion on which a sheet conveyed by a conveying portion is stacked;

a binding portion which forms, in a sheet bundle stacked on the first stacking portion, a tongue cut out from the sheet, with a part of the tongue attached to the sheet, and a slit, and which binds the sheet bundle by inserting a tip of the tongue of the sheet bundle in the slit of the sheet bundle;

a guide face configured to guide the sheet bundle bound by the binding portion; and a second stacking portion on which the sheet bundle bound by the binding portion is stacked, wherein the sheet processing apparatus is configured to perform:

automatic binding in which the sheet bundle stacked on the first stacking portion is bound by the binding portion, the sheet bundle including the sheet conveyed by a conveying portion, and the sheet bundle to be stacked on the second stacking portion is discharged in a first direction, and manual binding in which a sheet bundle inserted manually in the binding portion, in a second direction different from the first direction, is bound by the binding portion, and wherein recessed parts are formed on the guide face, one of the recessed parts extending in the first direction from the binding portion and other of the recessed parts extending in the second direction from the binding portion.

2. The sheet processing apparatus according to claim 1, wherein the recessed parts extend in a direction toward the second stacking portion and in a direction perpendicular to the direction toward the second stacking portion.

3. The sheet processing apparatus according to claim 1, wherein the sheet bundle moves in one of at least two directions from an opening of the binding portion, after a binding process to the sheet bundle is performed by the binding portion.

4. The sheet processing apparatus according to claim 1, wherein, in the automatic binding, the sheet bundle having been binding-processed by the binding portion moves in a predetermined moving direction to be conveyed to the second stacking portion, and wherein, in the manual binding, a sheet bundle is inserted into the binding portion from a direction crossing the predetermined moving direction.

5. The sheet processing apparatus according to claim 4, wherein the sheet bundle having been binding-processed is moved from the opening of the binding portion in a width direction perpendicular to the moving direction toward the second stacking portion, to sort the sheet bundle.

6. The sheet processing apparatus according to claim 1, wherein the binding portion is situated on a front side of the body of the sheet processing apparatus, and is located in the same position in both the manual binding and the automatic binding.

7. A sheet processing apparatus comprising:

a first stacking portion on which a sheet conveyed by a conveying portion is stacked;

a binding portion which forms, in a sheet bundle stacked on the first stacking portion, a tongue cut out from the sheet, with a part of the tongue attached to the sheet, and a slit, and which binds the sheet bundle by inserting a tip of the tongue of the sheet bundle in the slit of the sheet bundle;

a second stacking portion on which the sheet bundle bound by the binding portion is stacked; and a guide face configured to guide the sheet bundle bound by the binding portion, wherein a plurality of recessed parts is formed on the guide face, the recessed parts extending along the guide face from the binding portion such that the recessed parts are extending in different directions from each other.

8. The sheet processing apparatus according to claim 7, wherein at least one guide face of the binding portion has a recessed part extending in a direction toward the second stacking portion, and a recessed part extending in a direction perpendicular to the direction toward the second stacking portion.

9. The sheet processing apparatus according to claim 7, further comprising a pair of aligning portions which aligns the sheet bundle stacked on the first stacking portion, wherein an outer back surface of the aligning portion located on the front side of a body of the sheet processing apparatus, the aligning portion being one of the pair of the aligning portions, is configured to act as an abutting guide which stops the sheet bundle moving from an opening of the binding portion in a direction perpendicular to the direction toward the second stacking portion.

10. An image forming apparatus comprising:

an image forming portion which forms an image on a sheet;

a conveying portion which conveys the sheet on which an image is formed by the image forming portion;

a first stacking portion on which the sheet conveyed by the conveying portion is stacked;

a binding portion which forms, in a sheet bundle stacked on the first stacking portion, a tongue cut out from the sheet, with a part of the tongue attached to the sheet, and a slit, and which binds the sheet bundle by inserting a tip of the tongue of the sheet bundle in the slit of the sheet bundle;

a second stacking portion on which the sheet bundle bound by the binding portion is stacked;

a guide face which guides the sheet bundle bound by the binding portion; and a plurality of recessed parts formed on the guide face, the recessed parts extending along the guide face from the binding portion such that the recessed parts are extending in different directions from each other.

11. A sheet processing apparatus comprising:

a first stacking portion on which a sheet conveyed by a conveying portion is stacked;

a binding portion which binds a sheet bundle on the first stacking portion;

a second stacking portion on which the sheet bundle bound by the binding portion is stacked;

a guide face which guides the sheet bundle bound by the binding portion; and a plurality of recessed parts formed on the guide face, the recessed parts extending along the guide face from the binding portion such that the recessed parts are extending in different directions from each other.

12. The sheet processing apparatus according to claim 11, wherein the binding portion forms, in the sheet bundle stacked on the first stacking portion, a tongue cut out from the sheet, with a part of the tongue attached to the sheet, and a slit, and which binds the sheet bundle by inserting a tip of the tongue of the sheet bundle in the slit of the sheet bundle.

13. The sheet processing apparatus according to claim 11, wherein at least one guide face of the binding portion has a recessed part extending in a direction toward the second stacking portion, and a recessed part extending in a direction perpendicular to the direction toward the second stacking portion.

14. The sheet processing apparatus according to claim 11, wherein the sheet bundle moves in one of at least two directions from the binding portion, after a binding process to the sheet bundle is performed by the binding portion.

* * * * *